US009241536B2

(12) United States Patent
Smaldone et al.

(10) Patent No.: US 9,241,536 B2
(45) Date of Patent: Jan. 26, 2016

(54) UPPERS AND SOLE STRUCTURES FOR ARTICLES OF FOOTWEAR

(71) Applicant: NIKE, Inc., Beaverton, OR (US)

(72) Inventors: Patricia L. Smaldone, Portland, OR (US); Dylan S. VanAtta, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 145 days.

(21) Appl. No.: 14/040,038

(22) Filed: Sep. 27, 2013

(65) Prior Publication Data

US 2015/0089836 A1 Apr. 2, 2015

(51) Int. Cl.

| | |
|---|---|
| ***A43B 23/00*** | (2006.01) |
| ***A43B 23/02*** | (2006.01) |
| ***A43B 23/22*** | (2006.01) |
| ***A43B 1/02*** | (2006.01) |
| ***A43B 23/08*** | (2006.01) |
| ***A43B 23/14*** | (2006.01) |

(52) U.S. Cl.

CPC ..... *A43B 23/0205* (2013.01); *A43B 1/02* (2013.01); *A43B 23/00* (2013.01); *A43B 23/024* (2013.01); *A43B 23/0215* (2013.01); *A43B 23/0235* (2013.01); *A43B 23/0255* (2013.01); *A43B 23/0265* (2013.01); *A43B 23/0295* (2013.01); *A43B 23/085* (2013.01); *A43B 23/14* (2013.01); *A43B 23/22* (2013.01)

(58) Field of Classification Search

CPC .... A43B 23/00; A43B 23/02; A43B 23/0215; A43B 23/022; A43B 23/026; A43B 23/0265; A43B 23/0235; A43B 23/0295; A43B 23/0255

USPC ..... 36/84

See application file for complete search history.

(56) References Cited

U.S. PATENT DOCUMENTS

| | | | | |
|---|---|---|---|---|
| 74,858 | A | 2/1868 | Smith et al. | |
| 1,258,629 | A * | 3/1918 | Bliss | 36/45 |
| 1,763,605 | A | 6/1930 | Haskell | |
| 2,241,440 | A | 5/1941 | Bancroft | |
| 2,398,623 | A * | 4/1946 | Daniels | 12/146 R |
| 2,772,489 | A | 12/1956 | Porter | |
| 3,193,948 | A * | 7/1965 | Roberts | 36/84 |
| 3,271,887 | A | 9/1966 | Werman | |
| 3,535,799 | A * | 10/1970 | Onitsuka | 36/84 |
| 3,570,150 | A | 3/1971 | Field | |
| 4,309,832 | A | 1/1982 | Hunt | |

(Continued)

FOREIGN PATENT DOCUMENTS

| | | | |
|---|---|---|---|
| DE | 202006014446 | U1 | 11/2006 |
| WO | 99/05928 | A1 | 2/1999 |
| WO | 2008124163 | A1 | 10/2008 |

OTHER PUBLICATIONS

International Search Report and Written Opinion mailed Dec. 16, 2014 in PCT/US2014/057733.

(Continued)

*Primary Examiner* — Shaun R Hurley
*Assistant Examiner* — Bao-Thieu L Nguyen
(74) *Attorney, Agent, or Firm* — Banner & Witcoff, Ltd.

(57) ABSTRACT

Sole structures and uppers for articles of footwear are described that includes features to enhance footwear flexibility, dexterity, natural motion feel, and/or tackiness. Such articles of footwear may provide enhanced properties and feel for use in skateboarding and other activities.

34 Claims, 17 Drawing Sheets

(56) References Cited

U.S. PATENT DOCUMENTS

| | | | | |
|---|---|---|---|---|
| 4,438,574 | A * | 3/1984 | Johnson | 36/45 |
| 4,615,126 | A | 10/1986 | Mathews | |
| 4,858,339 | A * | 8/1989 | Hayafuchi et al. | 36/45 |
| 5,106,445 | A | 4/1992 | Fukuoka | |
| 5,345,638 | A * | 9/1994 | Nishida | 12/146 C |
| 5,384,973 | A | 1/1995 | Lyden | |
| 5,765,296 | A * | 6/1998 | Ludemann et al. | 36/51 |
| 5,800,900 | A * | 9/1998 | Mitchell | 428/100 |
| 5,809,669 | A * | 9/1998 | Hage et al. | 36/127 |
| 6,055,746 | A | 5/2000 | Lyden et al. | |
| 6,065,230 | A | 5/2000 | James | |
| 6,076,283 | A | 6/2000 | Boie | |
| 6,154,983 | A * | 12/2000 | Austin et al. | 36/12 |
| D435,958 | S | 1/2001 | White | |
| 6,401,364 | B1 * | 6/2002 | Burt | 36/3 A |
| 6,678,970 | B2 | 1/2004 | Liu | |
| D492,095 | S | 6/2004 | Sanchez et al. | |
| 7,017,286 | B2 | 3/2006 | Covatch | |
| 7,051,460 | B2 * | 5/2006 | Orei et al. | 36/84 |
| 7,191,550 | B2 | 3/2007 | Baek | |
| 7,347,011 | B2 * | 3/2008 | Dua et al. | 36/45 |
| D604,488 | S | 11/2009 | Amphyon | |
| D611,692 | S | 3/2010 | Bizzo | |
| 8,042,288 | B2 * | 10/2011 | Dua et al. | 36/45 |
| 8,291,619 | B2 | 10/2012 | Abadjian | |
| 8,429,835 | B2 * | 4/2013 | Dojan et al. | 36/3 A |
| 8,572,866 | B2 * | 11/2013 | Dojan et al. | 36/3 A |
| 8,578,535 | B2 * | 11/2013 | Dojan et al. | 12/142 R |
| 2001/0000272 | A1 * | 4/2001 | Attilieni | 36/3 A |
| 2001/0049889 | A1 * | 12/2001 | Chen | 36/55 |
| 2002/0078599 | A1 * | 6/2002 | Delgorgue et al. | 36/98 |
| 2002/0129519 | A1 * | 9/2002 | Cahan | 36/100 |
| 2003/0121181 | A1 * | 7/2003 | Chang | 36/45 |
| 2005/0076536 | A1 * | 4/2005 | Hatfield et al. | 36/3 B |
| 2005/0081402 | A1 * | 4/2005 | Orei et al. | 36/45 |
| 2005/0282454 | A1 * | 12/2005 | Meschter et al. | 442/306 |
| 2006/0048413 | A1 * | 3/2006 | Sokolowski et al. | 36/45 |
| 2007/0199210 | A1 * | 8/2007 | Vattes et al. | 36/45 |
| 2007/0245595 | A1 * | 10/2007 | Chen et al. | 36/45 |
| 2008/0016717 | A1 * | 1/2008 | Ruban | 36/21 |
| 2008/0141433 | A1 * | 6/2008 | Rhodes-Vivour | 2/69 |
| 2008/0201987 | A1 * | 8/2008 | Bell | 36/84 |
| 2008/0250668 | A1 * | 10/2008 | Marvin et al. | 36/54 |
| 2009/0100714 | A1 * | 4/2009 | Coger | 36/100 |
| 2009/0119948 | A1 | 5/2009 | Ortley et al. | |
| 2009/0313856 | A1 | 12/2009 | Arizumi | |
| 2010/0011619 | A1 * | 1/2010 | Bastianelli et al. | 36/87 |
| 2010/0186874 | A1 * | 7/2010 | Sussmann | 156/73.1 |
| 2011/0061266 | A1 * | 3/2011 | Hsieh et al. | 36/107 |
| 2011/0088282 | A1 * | 4/2011 | Dojan et al. | 36/45 |
| 2011/0088285 | A1 * | 4/2011 | Dojan et al. | 36/87 |
| 2011/0113648 | A1 * | 5/2011 | Leick et al. | 36/50.1 |
| 2011/0126428 | A1 | 6/2011 | Hazenberg et al. | |
| 2011/0302810 | A1 | 12/2011 | Borel et al. | |
| 2012/0066931 | A1 * | 3/2012 | Dojan et al. | 36/83 |
| 2012/0186102 | A1 * | 7/2012 | Lee et al. | 36/45 |
| 2012/0189852 | A1 * | 7/2012 | Lee et al. | 428/411.1 |
| 2012/0198730 | A1 * | 8/2012 | Burch et al. | 36/30 R |
| 2012/0255201 | A1 * | 10/2012 | Little | 36/84 |
| 2012/0267043 | A1 * | 10/2012 | Lee | 156/247 |
| 2013/0019508 | A1 * | 1/2013 | Smith et al. | 36/72 R |
| 2013/0025157 | A1 * | 1/2013 | Wan et al. | 36/45 |
| 2013/0055590 | A1 * | 3/2013 | Mokos | 36/45 |
| 2013/0104423 | A1 * | 5/2013 | Hatfield et al. | 36/103 |
| 2013/0264005 | A1 * | 10/2013 | Ou | 156/148 |
| 2013/0312284 | A1 * | 11/2013 | Berend et al. | 36/84 |
| 2014/0026438 | A1 | 1/2014 | Cortez et al. | |
| 2014/0059886 | A1 * | 3/2014 | Lyttle et al. | 36/55 |
| 2014/0317962 | A1 * | 10/2014 | Smith et al. | 36/102 |
| 2015/0013187 | A1 * | 1/2015 | Taniguchi et al. | 36/84 |

OTHER PUBLICATIONS

International Search Report and Written Opinion issued in International Application No. PCT/US2014/057239, mailed Dec. 17, 2014.

* cited by examiner

UPPERS AND SOLE STRUCTURES FOR ARTICLES OF FOOTWEAR

FIELD

Aspects of the present invention relate to uppers and/or sole structures for articles of footwear and articles of footwear including such uppers and/or sole structures. Some examples of the invention relate to sole structures having improved impact-attenuation and/or energy-absorption as well as improved flexibility and freedom of motion. Other aspects of this invention relate to uppers having characteristics well suited for allowing foot flexibility and/or for providing some "gripping" action. Some articles of footwear according to this invention are well suited for use as skateboard shoes.

BACKGROUND

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to more fully utilize the natural motion of the foot.

High-action sports, such as the sport of skateboarding, impose special demands upon players and their footwear. For example, during any given run, skateboarders perform a wide variety of movements or tricks (e.g., carving, pops, flips, ollies, grinding, twists, jumps, etc.). During all of these movements, pressure shifts from one part of the foot to another, while traction between the skateboarder and the skateboard must be maintained. Further, for the street skateboarder, traction between the skateboarder's shoe and the ground propels the skateboarder.

Additionally, skateboarding requires the skateboarder to apply pressure to portions of the skateboard using his or her feet in order to control and move the board. For certain tricks or moves, skateboarders selectively apply pressure to the board through their shoes at different locations on the bottom and/or edges of the shoes. For example, for some skateboarding tricks, pressure is applied by the sole of the foot along the lateral forefoot region, approximately at the outer toe line location. For other tricks, pressure is applied by the sole of the foot along the lateral region of the foot somewhat forward of the outer toe line location. For even other tricks, pressure may be applied under the toes, the ball of the foot, or even the heel.

For other tricks or moves, skateboarders may selectively apply pressure to the board through their shoes at different locations on the uppers and/or side edges of the shoes. For example, for some skateboarding tricks, such as a kick flip, pressure may be applied by the top of the toes of the foot, approximately across the top of the toe line location. For other tricks, such as an ollie, pressure may be applied by the top of the lateral forefoot portion of the foot.

As the interaction between the skateboarder and the skateboard is particularly important when performing such tricks, skateboarders have traditionally preferred shoes having relatively thin and flexible soles that allow the skateboarder to "feel" the board. Yet, at the same time, skateboard tricks have become "bigger," involving higher jumps and more air time, and importantly greater and greater impact loads and movement speeds. These bigger skateboard tricks may result in uncomfortably high, even damaging, impact loads being felt by the skateboarder. Given the large variety of tricks, different movements and landing positions, different portions of the foot may experience significant impact loads while other portions may not.

Accordingly, it would be desirable to provide footwear that allows the wearer to better feel and grip the ground, board, or other foot-contacting surfaces, to achieve better dynamic control of the wearer's movements, while at the same time providing impact-attenuating features that protect the wearer from impacts due to these dynamic movements.

BRIEF SUMMARY

Aspects of this invention relate to uppers and/or sole structures for articles of footwear. Such uppers and sole structures may provide a combination of improved impact-attenuation and/or energy-absorption as well as improved flexibility and freedom of motion (optionally including improved dorsiflexion and/or plantar-flexion). Aspects of this invention also relate to uppers having characteristics well suited for allowing foot flexibility and for providing "gripping" action. Some articles of footwear according to this invention are well suited as skateboard shoes.

More specific aspects of this invention relate to sole structures for articles of footwear that include: (a) a first sole portion including a first exposed bottom surface area; (b) a second sole portion including a second exposed bottom surface area; and (c) an elongated double curved channel (e.g., an S-shaped channel) located between (and separating) the first exposed bottom surface area and the second exposed bottom surface area. The elongated double curved channel may extend from a medial-side end at a forefoot region of the sole structure to a lateral-side end at or near a midfoot region of the sole structure. A forward portion of this elongated double curved channel may have a concave portion facing a medial edge of the sole structure and a rearward portion of this elongated double curved channel may have a concave portion facing a lateral edge of the sole structure. The double curved channel may be a deep channel, e.g., having a depth of at least 3 mm over at least 50% of its length (measured as described in more detail below).

Another aspect of this invention relates to sole structures for articles of footwear that include: (a) a first sole portion including a first exposed bottom surface area located at least in an arch support region of the sole structure; (b) a second sole portion including a second exposed bottom surface area located at least in a medial heel support region of the sole structure; and (c) an elongated heel channel located between (and separating) the first exposed bottom surface area from the second exposed bottom surface area. The elongated heel channel may extend from a heel edge to the medial edge (e.g., in the heel region) of the sole structure, and this heel channel may be a deep channel (e.g., having a depth of at least 3 mm over at least 50% of its length (measured as described in more detail below)). Sole structures according to aspects of this invention may include additional features, structures, and/or properties, including those described in more detail below.

Sole structures according to additional aspects of this invention may include: (a) a first sole portion including a first exposed bottom surface area located at least in a forefoot support region of the sole structure; (b) a second sole portion including a second exposed bottom surface area located at least in an arch support region of the sole structure; and (c) a transverse flexion channel (e.g., extending across the sole from the medial side-to-lateral side direction) located between (and separating) the first exposed bottom surface area of the first sole portion from the second exposed bottom surface area of the second sole portion. This transverse flexion channel (which may be double curved or S-shaped) includes a medial-side end at a forefoot region of the sole structure and a lateral-side end at or near a midfoot region of the sole structure. In this structure, the first sole portion may include: (a) a longitudinal flexion channel extending from a first end located proximate the lateral-side end of the transverse flexion channel and a second end located proximate a forward toe support region of the sole structure, (b) a first flexion channel extending from a lateral edge of the sole structure to a medial edge of the sole structure, (c) a second flexion channel extending from the lateral edge of the sole structure to the medial edge of the sole structure, and (d) a third flexion channel extending from the lateral edge of the sole structure to the transverse flexion channel. At least one (and preferably all) of the transverse flexion channel, the longitudinal flexion channel, the first flexion channel, and the second flexion channel (and optionally the third flexion channel) may be deep channels (e.g., having a depth of at least 3 mm over at least 50% of its respective length (measured as described in more detail below)).

Still additional aspects of this invention relate to uppers for articles of footwear. Such uppers may include, for example: (a) a mesh layer; and (b) one or more textile members joined to the mesh layer. A textile member may be formed as a multi-layered construction, if desired, and may include: (1) a first textile layer including a first surface and a second surface opposite the first surface, wherein the second surface includes a first hot melt adhesive layer, and (2) a second textile layer including a first surface and second surface opposite the first surface, wherein the second surface of the second textile layer includes a second hot melt adhesive layer. The first hot melt adhesive layer may be arranged to face and contact the second hot melt adhesive layer to thereby join the first textile layer with the second textile layer (e.g., when heat and/or pressure is applied). The first and second textile layers need not be co-extensive, and the hot melt adhesive layers may cover all or some portions of the interfacing surfaces. If desired, the textile member(s) may be joined to the mesh layer at less than an entire interfacing surface area of the mesh layer and the textile member(s) so that some overlapping portions of the mesh layer can move (or "float") relative to the textile member layer. The textile member(s) may be made, for example, from suedes and/or other materials, including substrate materials with TPU films, prints, and/or coatings.

Finally, still additional aspects of this invention relate to articles of footwear that include one or both of uppers of the various types described above and/or sole structures of the various types described above (and as are each described in more detail below).

BRIEF DESCRIPTION OF THE DRAWINGS

The foregoing Summary, as well as the following Detailed Description, will be better understood when read in conjunction with the accompanying drawings.

Figure 1:
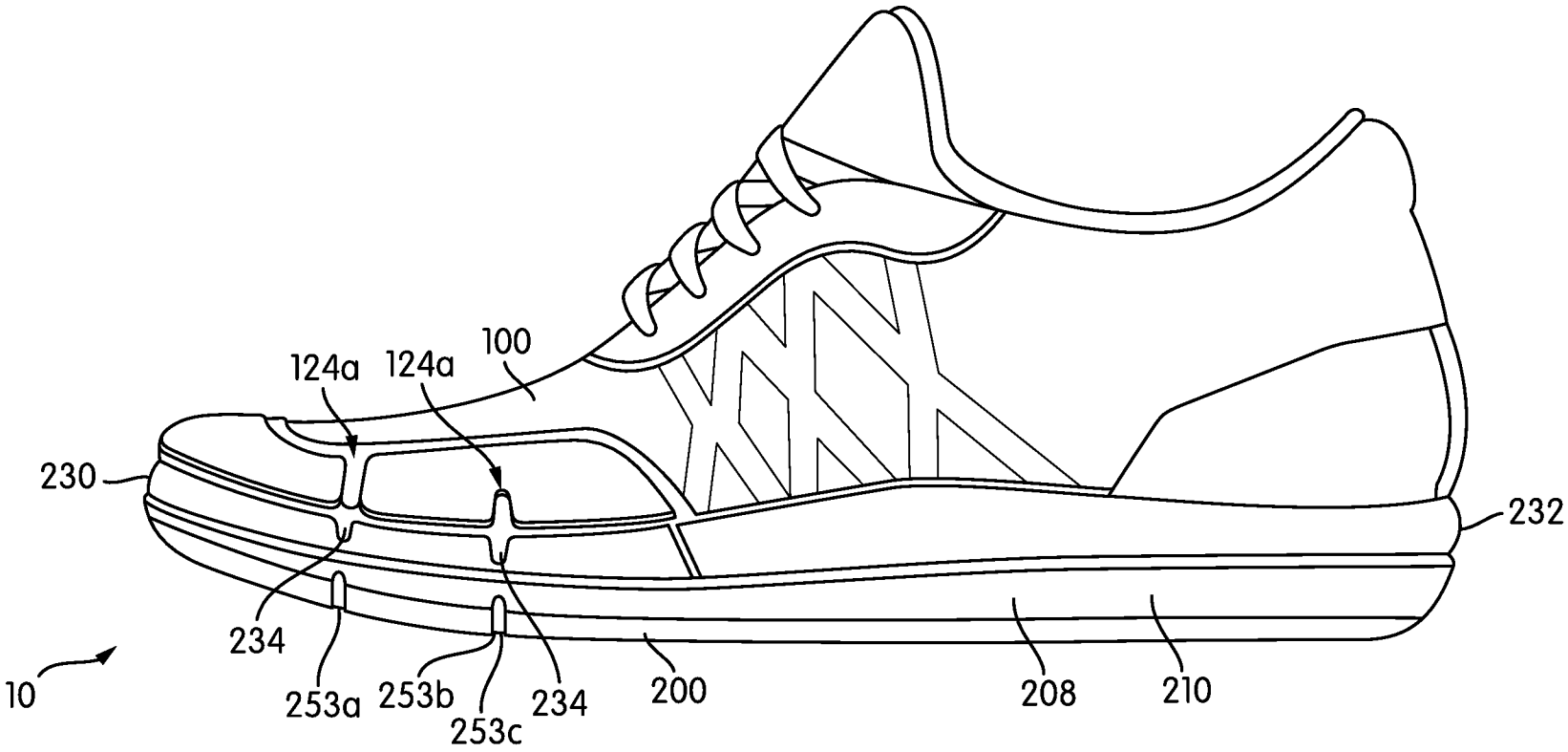
FIG. 1 is a medial side view of an article of footwear having an upper and a sole structure in accordance with aspects of this disclosure.

It should be understood that the appended drawings are not necessarily to scale, presenting a somewhat simplified representation of various features illustrative of specific aspects of the invention. Certain features of the illustrated embodiments may have been enlarged or distorted relative to others to facilitate visualization and clear understanding. In particular, thin features may be thickened, for example, for clarity of illustration.

DETAILED DESCRIPTION

The following discussion and accompanying figures disclose articles of footwear having sole structures and/or uppers with features in accordance with various embodiments of the present disclosure. Concepts related to the sole features and/or the upper features are disclosed with reference to an article of athletic footwear having a configuration suitable for the activity of skateboarding. However, the disclosed sole structures and/or upper structures are not solely limited to footwear designed for skateboarding, and these structures may be incorporated into a wide range of athletic footwear styles, including shoes that are suitable for rock climbing, bouldering, hiking, running, baseball, basketball, cross-training, football, rugby, tennis, volleyball, and walking, for example. In addition, sole structures and/or upper structures according to various embodiments as disclosed herein may be incorporated into footwear that is generally considered to be non-athletic, including a variety of dress shoes, casual shoes, sandals, slippers, and boots. An individual skilled in the relevant art will appreciate, given the benefit of this specification, that the concepts disclosed herein with regard to the sole structures and/or upper structures apply to a wide variety of footwear styles, in addition to the specific styles discussed in the following material and depicted in the accompanying figures.

Sports generally involve consistent pounding of the foot and/or periodic high impact loads on the foot. For example, skateboarding is a sport that is known to involve high impact loading under the foot, especially when unsuccessfully or awkwardly landing tricks and/or inadvertently coming off the board on hard, unforgiving surfaces. Over the past several years, skateboarding tricks have gotten much bigger, resulting in even higher impact loads, especially in the medial and the heel regions of the foot. This is true whether the foot remains on the board during landing or, alternatively, if the landing is off the board.

On the other hand, skateboarders and many other athletes desire sole structures and accompanying upper structures that are lightweight, low profile, and provide a good "feel" that allows for control of the skateboard, ball, etc. A sole structure and accompanying upper structure for an article of footwear capable of handling the high "big trick" impact loads, without sacrificing the intimate feel for the board desired by skateboarders, is sought. It may be advantageous to have a sole structure and accompanying upper structure that responds somewhat stiffly when a user is walking or performing relatively low impact ambulatory activities, thereby maintaining a feel for the ground surface (or board), and that also responds more compliantly when the user is performing higher impact maneuvers, thereby lessening excessively high impact forces that otherwise may be experienced by the user.

Even further, skateboarders and many other athletes desire sole structures that are highly flexible. Certain sports, particularly skateboarding, require the athlete to use not only the sole of the footwear to provide contact and control of an object (i.e., the board), but also the sides and the uppers of the shoe are used for contact and control. Thus, both dorsi-flexibility and plantar-flexibility of the sole and the overall footwear may be important. Dorsiflexion is movement that decreases the angle between the upper surface of the foot and the leg, so that the toes are brought closer to the shin. Put more simply: for purposes of this disclosure, "dorsiflexion" applies to the upward movement of the forefoot and/or the toes relative to the ankle joint. Movement of the forefoot and/or toes in the opposite direction (i.e., downward and away from the ankle joint) is called "plantarflexion."

In addition, the ability to "grip" the board, whether with the sole, the sides, or the upper of the article of footwear, is another important feature desired by skateboarders. Softer materials tend to provide higher coefficients of friction and, thus, generally provide better traction and "grip" than harder materials. However, softer materials also tend to wear out more quickly. Thus, another feature sought by skateboarders is a durable sole and/or a durable upper. Because of the abrasive nature of the top surface of a skateboard (e.g., typically equivalent to about 80 grit sandpaper) and the concrete or asphalt surfaces on which a skateboard is used, footwear durability can be a very important consideration when selecting a skateboard shoe.

Finally, fit is important to all athletes, so that the shoe hugs the user's foot, moves with the user's foot, comfortably supports the user's foot and does not rub or slip relative to the user's foot. Lightweight and breathability also are important features for such shoes. For skateboarding or other activities where the foot lands under high impact loads, the upper and/or sole structure may need to provide room for the foot to splay outward at the time of impact.

Various aspects of this disclosure relate to articles of footwear having sole structures and/or accompanying upper structures capable of addressing these various and sometimes seemingly conflicting design constraints.

As used herein, the modifiers "upper," "lower," "top," "bottom," "upward," "downward," "vertical," "horizontal," "longitudinal," "transverse," "front," "back" etc., unless otherwise defined or made clear from the disclosure, are relative terms meant to place the various structures or orientations of the structures of the article of footwear in the context of an article of footwear worn by a user standing on a flat, horizontal surface. Also, the term "S-shaped," as used herein, refers to a double curve shape with curves generally facing opposite directions, (e.g., the concave side of one curve facing generally upward and the concave side of the adjoining curve facing generally downward, the concave side of one curve generally facing right and the concave side of the adjoining curve generally facing left, etc.). Such double curve shapes may appear similar in structure to a capital "S" (with generally two adjoined, oppositely curved regions). A curve is "S-shaped" regardless of whether the structure is oriented like an "S" or like a mirror image of an "S". Also, the individual curves of a double curve structure can have any depths, slopes, and/or sharpness (including curves of different depths, slopes, and/or sharpnesses) and still be considered an "S-shaped curve."

The terms "deep channel," "deep groove," and "primary groove" are used interchangeably and synonymously in this specification, and the terms "secondary channel" and "secondary groove" are used interchangeably and synonymously in this specification. In general, primary grooves may be deeper and/or wider than any secondary grooves provided in the same sole structure (if any secondary grooves are provided). Because of their relatively deep and/or wide structure, deep channels or primary grooves may be used in areas of a sole structure to facilitate plantar-flexion as well as dorsi-flexion at that area. Because of their relatively shallow and/or narrow structure, secondary channels or secondary grooves may be used in areas of the sole structure primarily to facilitate dorsi-flexion at that area (plantar-flexion may be limited across a secondary groove because the nearby adjacent material across the groove prevents substantial relative motion of the sole structure in a manner to close the groove). While other options are possible, in some footwear sole structures, deep grooves may be directly molded into the sole structure (e.g., molded into a polymer foam material) and secondary grooves may be cut into the sole structure (e.g., cut via a laser or a hot knife cutting process).

Also, various dimensions and measurements are described in this specification. Unless otherwise noted or clear from the context, these dimensions are provided and/or these measurements are made with the article of footwear or other object (or any portion thereof) in an unstressed or unloaded condition (e.g., not supporting the weight of a wearer, sitting on a horizontal surface).

The human foot is a highly developed, biomechanically complex structure that serves to bear the weight of the body as well as forces many times the weight of the human body during walking, running, jumping, etc. The primary twenty-six bones of the human foot can be grouped into three parts: the seven tarsal bones; the five metatarsal bones; and the fourteen phalanges. Additionally, sesamoid bones are located at the distal ends of the metatarsal bones. The phalanges, metatarsals, and sesamoids may further be numbered from one to five, with the first phalange, metatarsal, and/or sesamoids being associated with the medial-side (i.e., the big toe, etc.) and the fifth phalange, metatarsal, and/or sesamoids being associated with the lateral-side (i.e., the little toe, etc.).

The foot itself may be divided into three parts: the heel, the midfoot, and the forefoot. The heel is composed of two of the seven tarsal bones, i.e., the talus and the calcaneus. The midfoot contains the rest of the tarsal bones. The forefoot contains the metatarsals (and the sesamoids) and the phalanges.

Description of Specific Embodiments

Referring to FIGS. 1-4, an article of footwear 10 generally includes two primary components: an upper structure 100 and a sole structure 200. The upper structure 100 is secured to the sole structure 200 and forms a void in the interior of the footwear 10 for comfortably and securely receiving a foot. The sole structure 200 is secured to a lower portion of the upper structure 100 and is positioned between the foot and the ground. Upper structure 100 generally includes an ankle opening that provides the user's foot with access to the void within upper structure 100. As is conventional, upper structure 100 also may include a vamp area having a throat and a closure mechanism, such as laces.

Figure 11:
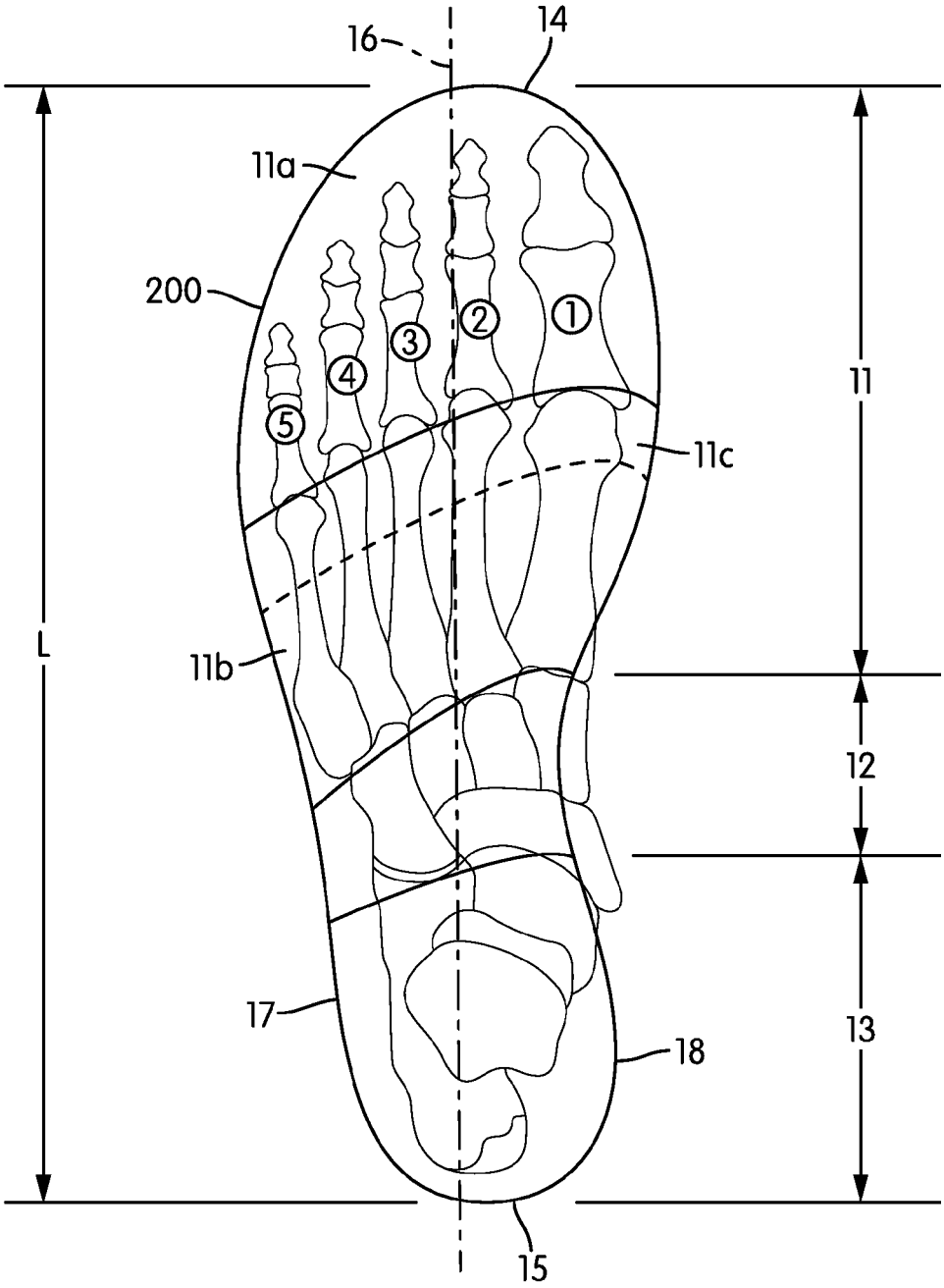
FIG. 11 is a schematic illustration showing example regions of an article of footwear (and particularly of a sole structure) relative to a typical user's bone structure in accordance with various aspects of this disclosure.

Referring to FIG. 11, typically, the sole structure 200 of the article of footwear 10 has a forefoot region 11, a midfoot region 12 and a heel region 13. Forefoot region 11 generally extends across a user's forefoot as described above; midfoot region 12 generally extends across a user's midfoot as described above; and heel region 13 generally extends across a user's heel as described above. Forefoot region 11 further may be considered to encompass a phalange region 11*a*, a metatarsal region 11*b* and a sesamoid region 11*c* within the metatarsal region 11*b*. Thus, each region 11*a*-11*c*, 12 and 13 is generally associated with the corresponding region of a typical user's foot. Although regions 11-13 apply generally to sole structure 200, references to regions 11-13 also may apply to article of footwear 10, upper structure 100, and/or an individual component within the sole structure 200, upper structure 100, and/or footwear structure 10.

Still referring to FIG. 11, the article of footwear 10, including the sole structure 200 and the upper structure 100, further has a toe or front edge 14 and a heel or back edge 15. A lateral edge 17 and a medial edge 18 each extend from the front edge 14 to the back edge 15. Further, the article of footwear 10 defines a longitudinal centerline 16 extending from the back edge 15 to the front edge 14 and located generally midway between the lateral edge 17 and the medial edge 18. Longitudinal centerline 16 generally bisects article of footwear 10 and particularly the sole structure 200, thereby defining a lateral side and a medial side.

Sole

According to some embodiments, sole structure 200 may be formed from one or more components and/or may incorporate multiple layers, for example, an outsole structure and a midsole structure, etc. Generally speaking, the outsole structure forms the lowermost, ground-engaging portion (or other contact surface-engaging portion) of the sole structure 200, thereby providing traction and a feel for the engaged surface. The outsole structure also may provide stability and localized support for the foot. Even further, the outsole structure may provide impact-attenuation capabilities. Aspects of certain outsole structures will be discussed in detail below.

An insole (or sockliner) also may be provided in an article of footwear 10. An insole (not shown), is generally a thin, compressible member located within the void for receiving the foot and proximate to a lower (plantar) surface of the foot. The insole, which is configured to enhance footwear comfort, may be formed of foam or other soft, conforming material. For example, the insole may be formed of a 5 mm thick layer of polyurethane foam, e.g., injection Phylon. Other materials, such as ethylene vinyl acetate or other foamed polyurethane and/or rubber materials may be used to form an insole. Typically, the insole or sockliner is not glued or otherwise attached to the other components of the sole structure 200 and/or the upper 100, although it may be attached, if desired.

In addition to outsole structures, certain sole structures also may include midsole structures. In certain conventional sole structures, midsoles form a middle layer of the sole structure 200 and are positioned between the outsole structure and the upper and/or insole. The midsole may be secured to the upper structure 100 along the lower length of the upper. Midsoles typically are designed to have impact-attenuation capabilities, thereby attenuating ground (or other contact surface) reaction forces and lessening stresses experienced by the user's foot and leg. Further, midsoles may provide stability and/or additional localized support or motion control for the foot or portions of the foot. According to certain aspects of this invention, however, a midsole need not be provided. This may be particularly appropriate when the sole structure 200 is designed to have a low profile and/or to be very lightweight.

Optionally, the footwear structure 10 may further include a strobel. The strobel, when present, typically connects lower edges of the upper and closes off the bottom of the foot-receiving void in the shoe 10. Typically, a strobel is a sole-shaped element sewn or otherwise attached to the upper 100 that may include thin flexible materials, thicker and/or stiffer materials, compressible materials or a combination thereof to improve stability, flexibility and/or comfort. For example, a strobel may include a cloth material, such as a woven or non-woven cloth supplied by Texon International, or a thin sheet of EVA foam for a more cushioned feel. For some applications, the strobel may be thicker in the heel region than in the forefoot region. For other applications, the strobel may be provided only in the forefoot region, only the midfoot region, only the heel region, or select portions or combinations of these regions. A strobel may replace an insole member or sock liner, if desired. Typically, an insole or sock liner will be provided, if at all, within an interior chamber defined by the upper and strobel.

Figure 5:
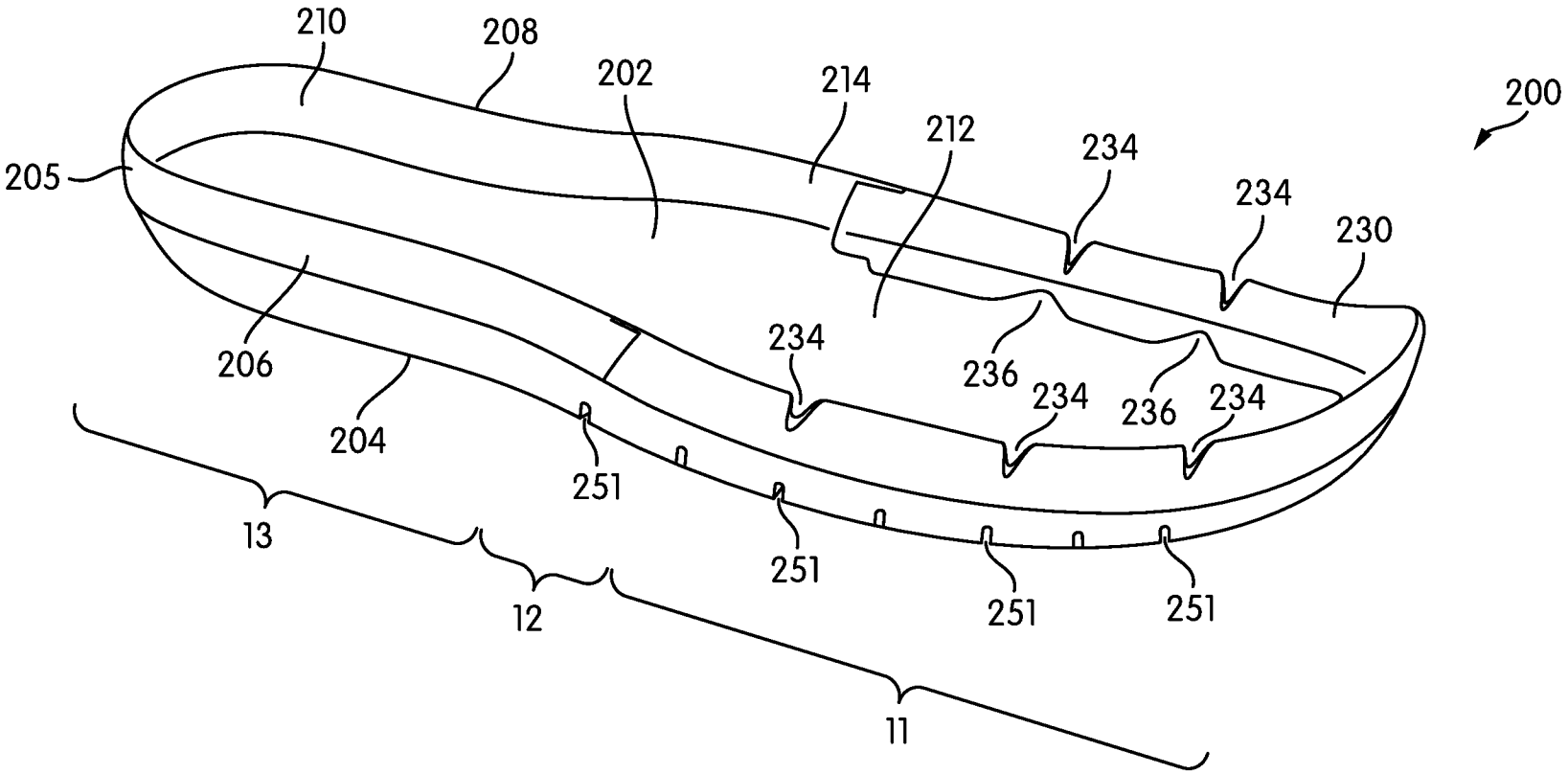
FIG. 5 is a perspective view, looking from the top, lateral side, of the sole structure of an article of footwear in accordance with aspects of this disclosure.

Referring now to FIG. 5, according to certain aspects, the sole structure 200 may have an upper surface 202 upon which a user's foot applies pressure, a lower or ground-contacting surface 204 and a side surface 206 extending around a perimeter edge 208 between the upper and the lower surfaces 202, 204. FIG. 5 illustrates an embodiment of the sole structure 200 that is configured as a cup sole 205, having a relatively horizontal platform upon which a user's foot rests surrounded by an upwardly extending sidewall. According to certain embodiments, the sole structure 200 may be formed as a single integral item. As one example, the sole structure 200 may be unitarily molded of a single material. As another example, a first sub-component of the sole structure 200 may be formed and then a second sub-component may be co-molded to the first sub-component. As even another example, various sub-components of the sole structure 200 may be formed separately and then finish vulcanized or adhesively bonded to one another. The sub-components may be made of similar or dissimilar materials.

Figure 6:
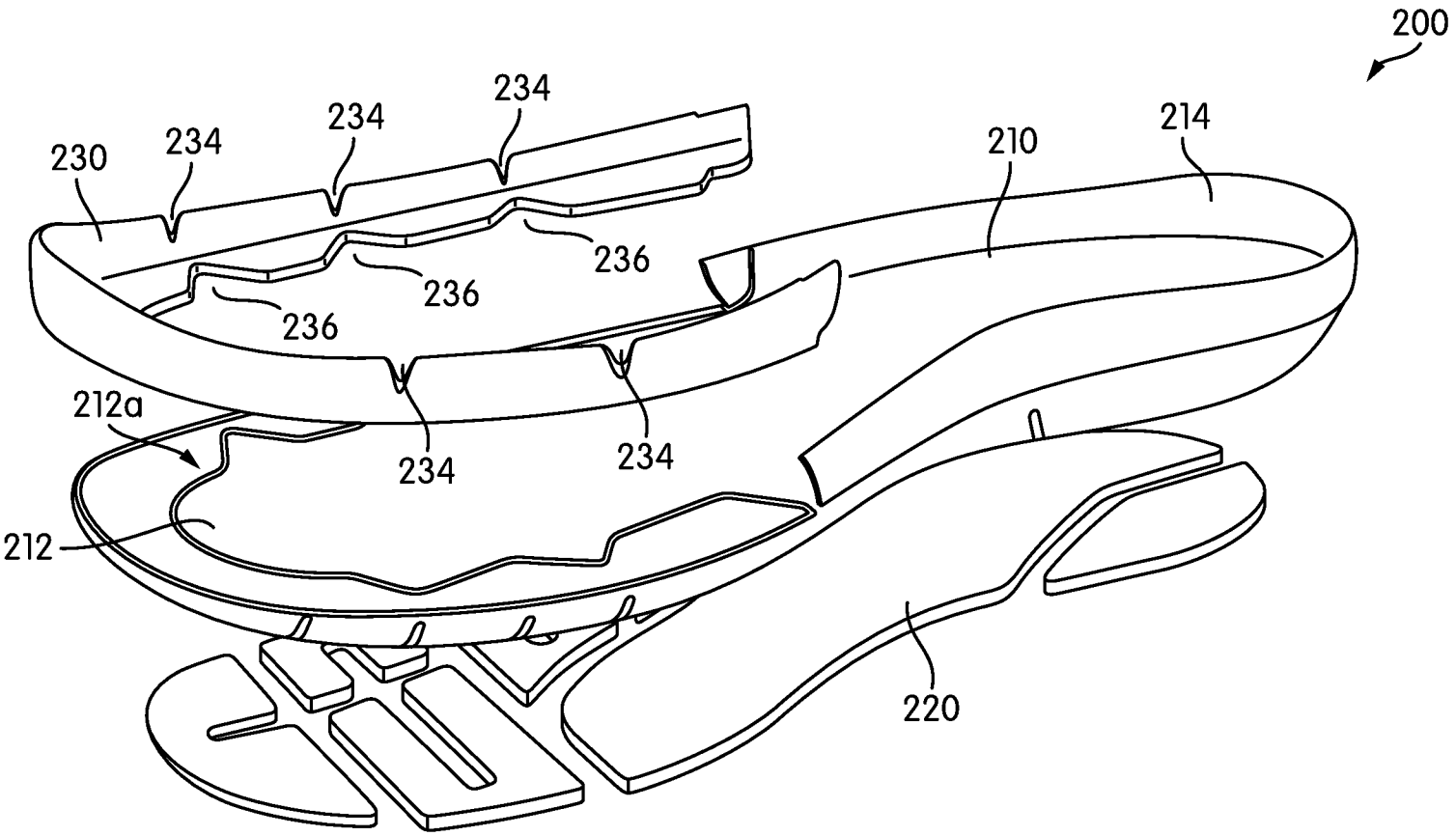
FIG. 6 is an exploded perspective view, looking from the top, of the sole structure of FIG. 5.
Figure 7:
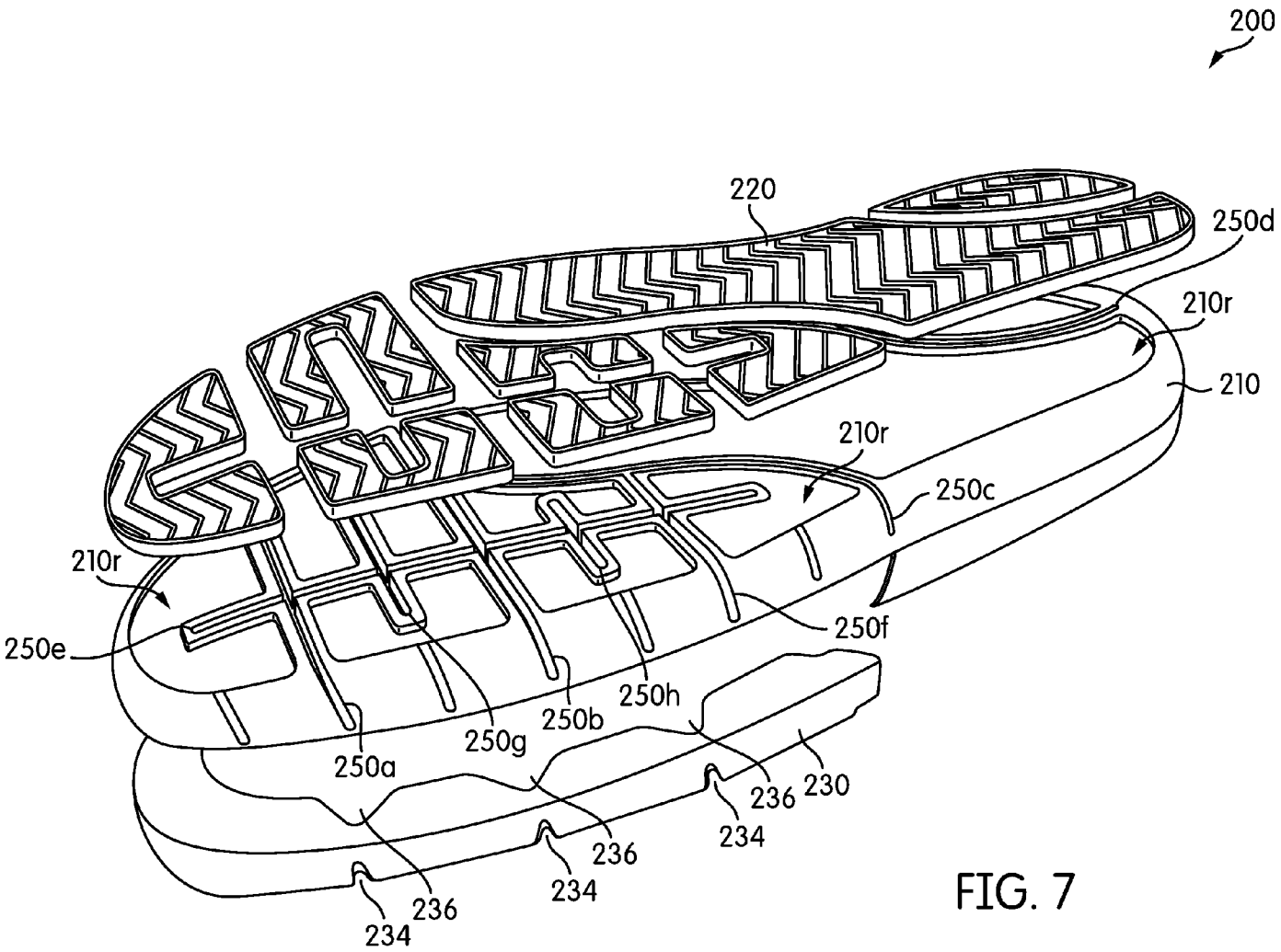
FIG. 7 is another exploded perspective view, looking from the bottom, of the sole structure of FIG. 5.

Thus, as shown in FIGS. 5-7, the sole structure 200 may include a platform 210, a ground-contacting or tread layer 220 and a forefoot sidewall component 230. The platform 210, tread layer 220 and sidewall component 230 may form an outsole or an outsole/midsole combination (e.g., with platform 210 functioning as the primary midsole component). Optionally, the platform 210, tread layer 220 and sidewall component 230 may form a cup sole. According to certain embodiments, the platform 210, the tread layer 220 and the forefoot sidewall component 230 each may be formed separately and then finish vulcanized or adhesively bonded to one another (FIGS. 6 and 7 show shallow recesses in various surfaces of the platform 210 for receiving the tread layer 220 and the sidewall component 230 in this example structure). In other embodiments, the tread layer 220 and/or the forefoot sidewall component 230 may be co-molded to the platform 210. In even other embodiments, the tread layer 220 and/or the forefoot sidewall component 230 may be formed as a unitarily molded unit with the platform 210.

Figure 4:
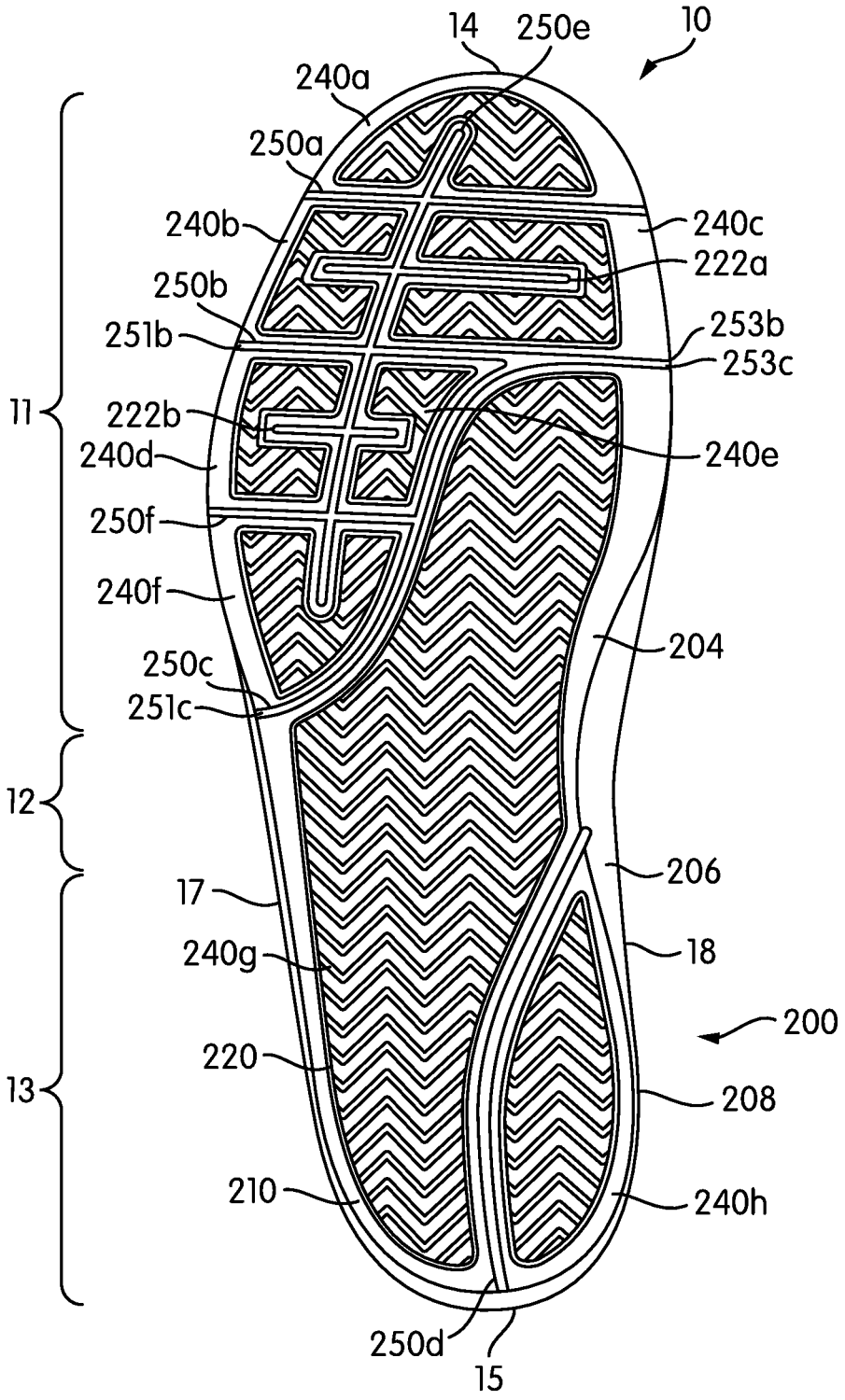
FIG. 4 is a bottom view of the article of footwear of FIG. 1.

In the particular embodiment of FIGS. 5-7, the sole structure 200 and the platform 210 extend over the entire sole region, from the heel 15 to the toe 14 and from the lateral side 17 to the medial side 18. Further, in this particular embodiment, a separate tread layer 220 also extends over the entire sole region (although, as shown in FIGS. 4, 6, and 7, the tread layer 220 may constitute a multi-piece construction leaving gaps (e.g., for the flex grooves or channels) between adjacent pieces of the tread layer 220). In other embodiments, a separate tread layer 220 may extend only over a portion of the sole structure 200. In such case, a bottom surface of the platform 210 may be provided with an integrally formed ground-contacting surface in those regions where no separate tread layer 220 is provided.

Platform 210 may include a foot bed 212 and a sidewall 214. The upper surface of foot bed 212 may be contoured to accommodate the sole geometry of a typical user's foot. Further, foot bed 212 may be specifically designed for attenuating impact loads, and as such, foot bed 212 may include a foamed material or other impact-attenuating elements (e.g., ethylvinylacetate foam, polyurethane foam, foamed rubbers, etc.). Even further, the entire foot bed 212 (and indeed the entire platform 210) may be formed as a single, unitarily-molded component. As shown in these figures, a sidewall 214 may extend along the perimeter edges of the foot bed 212, e.g., at least in the midfoot and/or heel regions 12, 13 of the sole structure 200. The upwardly projecting sidewall 214 may assist with positioning and supporting the user's foot and also with stiffening the platform 210. The sidewall 214 may be unitarily molded with foot bed 212 of the same material as foot bed 212. In other alternative embodiments, platform 210 need not include unitarily-molded sidewalls 214 and/or the sidewalls 214 may extend around less or more of the perimeter of the foot bed 212. Thus, according to one embodiment (not shown), unitarily-molded sidewalls may extend around just the heel region. According to another embodiment (not shown), unitarily-molded sidewalls 214 may extend around the entire foot bed 212.

The tread layer 220 may be formed as a relatively constant thickness layer, and it may include materials and/or structures for enhancing traction and/or durability. As shown in FIGS. 6 and 7, tread layer 220 may be formed as a discontinuous layer, i.e., ground-contacting layer 220 may be provided as a plurality of separated sections. The various sections may be formed of similar or dissimilar materials. Further, the various sections may be formed with similar or dissimilar tread configurations. The materials and/or the tread configurations may be chosen for traction, durability, energy absorption, energy dissipation, energy rebound, flexibility, stiffness, etc. For example, one or more sections may be provided with greater traction characteristics than other of the sections; one or more sections may be provided with greater durability characteristics than other of the sections; one or more sections may be provided with greater impact-attenuation characteristics than other of the sections; etc. Further, the thickness of the tread layer 220 may be different in different sections or regions of the sole structure 200, and need not be constant across any given section.

For purposes of this disclosure, a "tread layer" refers to the relatively thin portion of the sole structure 200 that contacts the ground. Although a tread layer may have grooves or other tread features, these tread features generally will not have a depth greater than 20% of the thickness of the sole structure 200 (e.g., the thickness associated with the thickness of the platform 210 plus the tread layer 220) at the location of the tread feature. In some structures in accordance with this invention, tread features such as grooves further may be characterized as not extending completely across the sole structure 200, i.e., as not extending from one portion of the perimeter edge 208 to another portion of the perimeter edge 208 of the sole structure 200. According to other aspects, a tread feature additionally may be characterized as not extending through the perimeter walls or sidewalls of the sole structure 200. In some example structures according to this invention, however, tread layers 220 may include one or more tread features (such as herringbone type grooves) that extend continuously from one side of the sole structure 200 to the other.

Figure 18:
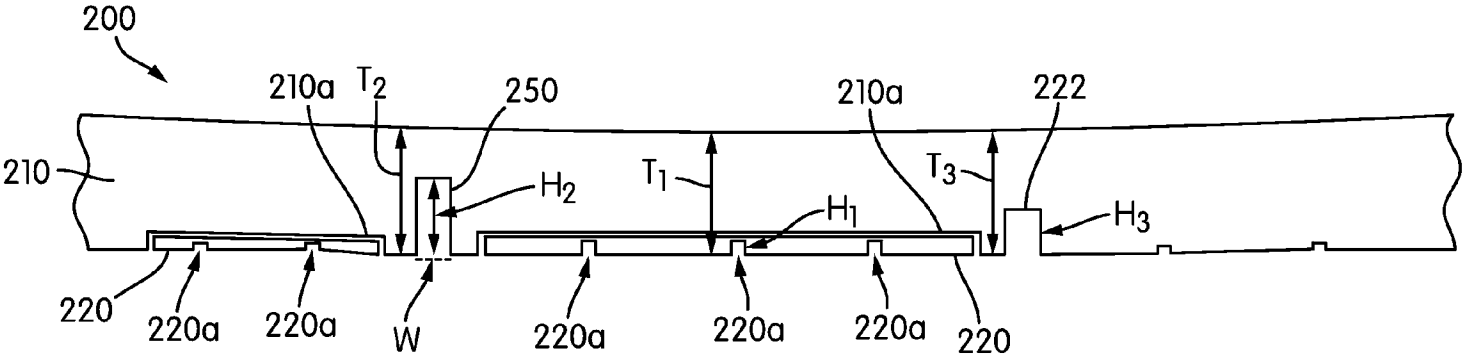
FIG. 18 is a cross sectional view of one example sole member structure used to illustrate various features of sole members in accordance with at least some aspects of this disclosure.

FIG. 18 helps illustrate potential characteristics of tread features in sole structures 200 in accordance with at least some examples of this invention. As shown in this figure, this example sole structure 200 includes a platform 210 that has one or more recesses **210*a* formed in its bottom surface for receiving one or more tread layers 220. While a single tread layer 220 is shown in each recess 210*a* of the example of FIG. 18, multiple tread layers 220 may be provided within a single recess 210*a*, if desired. The tread layer(s) 220, in turn, include one or more tread features, such as grooves 220*a* (optionally in a herringbone type configuration), formed in their bottom surfaces. In at least some structures in accordance with this invention, the tread features (e.g., grooves 220*a*) will have a depth (e.g., $H_1$) that is 20% or less than an overall thickness (e.g., $T_1$) of the sole member 200 adjacent the location where the depth of that tread feature is measured (i.e., $H_1/T_1 \leq 0.2$). As can be appreciated from FIG. 18, the $H_1/T_1$ ratio need not be constant for all tread features 220*a* in a tread layer 220 and/or in a sole structure 200. Also, the $H_1/T_1$ ratio need not be constant along an entire length (into and out of the page of the view of FIG. 18) of the tread feature 220*a*. In some examples of this invention, the $H_1/T_1$ ratio for a given tread feature 220*a* will be less than 0.2 over at least 50% of that tread feature's length, and in some examples, less than 0.2 over at least 75%, at least 90%, or even over 100% of that tread feature's length. Optionally, if desired, the $H_1/T_1$ ratio for a given tread feature 220*a*** will be less than 0.1 over at least 50% of that tread feature's length, and in some examples, less than 0.1 over at least 75%, at least 90%, or even over 100% of that tread feature's length. The "thickness" of the sole structure includes the thickness of any midsole and/or outsole member at the measurement location beneath or outside the upper, but it excludes any upper thickness, interior insole member thickness, lasting board thickness, strobel member thickness, etc.

The forefoot sidewall component 230 may be formed as one or more separate components that is/are subsequently joined to platform 210. Referring now to the embodiment of FIGS. 1-4, it is shown that the forefoot sidewall component 230 may be formed as a portion of a sidewall component 232 that extends over the entire perimeter 208 of the sole structure 200. Optionally, the forefoot sidewall component 230 may be provided as a separate component from midfoot and/or heel sidewall components (if any). Thus, referring now to the embodiment of FIGS. 5-7, it is shown that the forefoot sidewall component 230 may extend over the entire forefoot perimeter, i.e., from the midfoot region 12 on the lateral side 17 toward the toe 14, around the toe 14, and then toward the heel 15 to the midfoot region 12 on the medial side 18. Optionally, the forefoot sidewall component 230 may extend over one or more portions of the forefoot perimeter. The forefoot sidewall component 230 may be continuous, discontinuous, or provided as multiple pieces over the extent of the perimeter that it covers.

According to one embodiment, both platform 210 and forefoot sidewall component 230 may be molded separately and then, subsequently, adhesively bonded (or optionally, finish vulcanized) to one other. FIG. 6 shows shallow recesses 212*a* in the top surface 212 of platform 210 for receiving the flanges of forefoot sidewall component 230. According to other embodiments, forefoot sidewall component 230 may be co-molded to foot bed 212 of platform 210, such that forefoot sidewall component 230 is not formed separately prior to being joined to foot bed 212. Forefoot sidewall component 230 may include materials, surface textures and/or other features for enhancing grip, traction, and/or durability. Generally, a relatively soft material, such as rubber, polyurethane, etc., may be provided to enhance the gripping capability of the toe and side surfaces of the sidewall component 230. Even further, the forefoot sidewall component 230 may include special coatings or thin layers applied to its exterior surface to enhance the gripping capability.

Referring back to the embodiment of FIGS. 1-4 and especially to FIG. 4, the sole structure 200 of the article of footwear 10 may include a plurality of sole portions or zones 240 extending over the ground-contacting or lower surface 204. As shown in this particular example, a plurality of sole portions or zones 240*a*-240*f* may be located in the forefoot region 11; another sole portion or zone 240*g* may be located in the forefoot region 11, in the midfoot region 12 and in the heel region 13; and another sole portion or zone 240*h* may be located in the heel region 13. In this particular embodiment, zones 240*a*-240*f* are located completely in the forefoot region 11. Zone 240*g* extends over the entire midfoot region 12 and over portions of the forefoot region 11 and heel region 13. Zone 240*h* is located completely in the heel region 13.

Each of these sole portions or zones 240 are demarcated or separated from the other zones at the bottom of the sole structure 200 by one or more deep channels 250. For purposes of this disclosure, a "deep channel" (or "primary groove") refers to a groove or channel having a depth greater than or equal to 50% of the thickness of the sole member over at least 50% of its length (the "50% depth" feature may be provided continuously or discontinuously along the groove's length). Thus, should a groove or channel have a depth greater than 50% of the depth of the thickness of the sole member 200 over at least half of its length, it would be considered a deep channel 250.

FIG. 18 helps illustrate potential characteristics of deep grooves 250 in sole structures 200 in accordance with at least some examples of this invention. As shown in this figure, this example sole structure 200 includes a platform 210 that has one or more grooves formed in it. A groove is considered a "deep groove" (or a "primary groove") if its depth or height (e.g., $H_2$) is 50% or more than an overall thickness (e.g., $T_2$) of the sole member 200 adjacent the location where the groove depth $H_2$ is measured over at least 50% of its length (i.e., $H_2/T_2 \geq 0.5$ for 50% or more of the groove's length). The $H_2/T_2$ ratio need not be constant for all "deep grooves" 250 in a sole member 200. Also, the $H_2/T_2$ ratio need not be constant along an entire length of the deep groove 250 (into and out of the page of the view of FIG. 18). In some examples of this invention, the $H_2/T_2$ ratio for a given deep groove will be 0.5 or more over at least 50% of that deep groove's length, and in some examples, 0.5 or more over at least 75%, at least 90%, or even over 100% of that deep groove's length. Optionally, if desired, the $H_2/T_2$ ratio for a given deep groove will be 0.7 or more over at least 50% of that deep groove's length, and in some examples, 0.7 or more over at least 75%, at least 90%, or even over 100% of that deep groove's length.

Advantageously, according to certain embodiments, the groove depth-to-sole member thickness ratio (the $H_2/T_2$ ratio) of at least some deep grooves 250 may be at least 0.6, at least 0.7, and even more preferably at least 0.8 over at least 50% of the groove's length. At a ratio of 0.8, a deep channel 250 provided in a platform 210 having a thickness of 8 mm at a given cross-section location would have a depth of at least 6.4 mm at that same cross-section location.

According to some aspects, a deep channel 250 further may be characterized as extending completely across the sole structure 200 from one portion of the perimeter edge 208 to another portion of the perimeter edge of the sole structure 200. By way of non-limiting examples, a deep channel 250 may extend from a perimeter edge portion on a lateral side 17 to a perimeter edge portion on a medial side 18; from a perimeter edge portion on a heel side 15 to a perimeter edge portion on a medial side 18; from a perimeter edge portion on a toe side 14 to a perimeter edge portion on a lateral side 18; or even from a perimeter edge portion on a medial side 18 to another perimeter edge portion on a medial side 18; etc. According to other aspects, a deep channel 250 additionally may be characterized as extending through the perimeter walls 208 or the sidewalls 206 of the sole structure 200.

For the purposes of this disclosure, when sole portions or zones 240 are described as being "separated" by a deep channel 250, the lower surfaces 204 of the adjacent zones 240 are completely disconnected from one another. In other words, the lower surfaces 204 of adjacent zones 240 which are "separated" by a deep channel 250 are not attached or joined to each other. For example, a deep channel 250 may extend continuously across the lower surface 204 of the sole structure 200 from one point on the perimeter edge 208 of the sole structure 200 to another point on the perimeter edge 208 of the sole structure 200, thereby completely separating the adjacent zones 240 from one another at their bottom surfaces. Notably, however, adjacent sole portions 240 may be connected as a unitary construction, e.g., at the top, foot-supporting surface 212 of the platform 210.

Additionally, for purposes of this disclosure, when zones 240 are described as being "demarcated" by a deep channel 250, the lower surfaces 204 of the adjacent zones 240 are almost entirely but not completely disconnected from one another. In other words, some minor portions of the adjacent lower surfaces 204 of the adjacent zones 240 remain joined. For example, a ligament or other relatively thin connecting element may extend across the deep channel 250, or the deep channel 250 may not extend end-to-end completely across the corresponding dimension of the zone 240 to a perimeter edge 208. For example, the zone may extend completely from the lateral edge 17 to the medial edge 18 of the sole structure 200, but the demarcating deep channel 250 may stop short of one or both of the edges, such that the demarcating deep channel 250 does not extend completely across the sole structure 200.

Nonetheless, if zones 240 are "demarcated" by a deep channel 250, the length of the demarcating deep channel 250 is at least five times the summed length of any connecting portions. Thus, for example, according to this five-to-one embodiment, a 50 mm long demarcating deep channel 250 may be bracketed on each end by 5 mm long connecting portions that separate the deep channel 250 ends from the sole member sidewalls (i.e., the total or summed length of the connection portions being 10 mm). Advantageously, the length of the demarcating deep channel 250 may be at least seven times the length of the summed length of any connecting portions, and more preferably, at least nine times the length of the summed length of any connecting portions. Thus, for example, according to the nine-to-one embodiment, a 45 mm long demarcating deep channel 250 may extend from a first point on the perimeter edge to within 5 mm of a second point on a perimeter edge.

In the embodiment of FIGS. 1-4, deep channels 250 are provided as elongated slots extending upwardly into the lower surface 204 of the sole structure 200 and/or into the lower surface of the platform 210. Each deep channel 250 extends from a first end 251 to a second end 253. In a preferred embodiment, the first and second ends 251, 253 may be located at points on the perimeter edge 208 of the sole structure 200 and extend all the way through the sidewall structure 206 or perimeter wall 208 of the sole structure 200, such that the deep channel 250 is open at both ends. As best shown in FIGS. 1, 2, 6 and 7, the lateral-side (and/or medial-side) ends of the deep channels 250 may extend through the lateral (and/or medial) sidewall or perimeter wall of the sole structure 200 to the full depth of the deep channel. Optionally, the first and second ends 251, 253 may be located at the perimeter edge 208 of the sole structure 200, but the deep channel 250 may extend all the way through the sidewall structure 206 only at one end. In other embodiments, the deep channel 250 may extend between a perimeter edge 206 and another deep channel 250, or the deep channel 250 may extend between two other deep channels 250. In even other embodiments, the deep channel 250 may end within an interior portion of the lower surface 204, i.e., one or both of the ends 251, 253 are not located on the perimeter edge 208.

According to some aspects, a deep channel 250 further may be characterized by an absolute depth value. Generally, the deeper a channel extends into the thickness of the platform 210 or sole structure 200, the greater the degree of flexibility exhibited by the sole structure 200. According to one embodiment, when a deep channel 250 is characterized by an absolute depth value (e.g., $H_2$ in FIG. 18), a deep channel 250 may have a depth of at least 2 mm along at least 50% of its length. This lower limit on the absolute depth value may be particularly appropriate in the forefoot region 11. Advantageously, a deep channel 250 may have a depth of at least 3 mm, at least 4 mm or even at least 5 mm over at least 50% of its length. An absolute depth value of at least 4 mm may be particularly appropriate in the heel region 13, wherein the thickness of the platform 210 is generally greater than the thickness of the platform 210 in the forefoot region 11. A very flexible sole structure 200 may be achieved with one or more deep channels 250 having a depth of at least 6 mm, at least 7 or even at least 8 mm over at least 50% of its respective length.

According to other aspects, a deep channel 250 optionally may be further characterized by a channel depth-to-channel width ratio. The "width" of a channel is the distance W (see FIG. 18) across the channel as measured at a bottom surface of the sole structure (measuring in a direction directly across and not along the length of the channel). When a deep channel 250 is characterized by a channel depth-to-channel width ratio (e.g., $H_2$/W from FIG. 18), a deep channel 250 may have a depth-to-width ratio of at least 2 (when measured at a given location). The depth-to-width ratio may vary along the length of the channel 250 (into and out of the view of FIG. 18). However, for at least some deep channels 250, the depth-to-width ratio will be greater than or equal to 2 over at least 25% of the groove's length (and in some examples, over at least 50% or even over at least 75% of the groove's length). Thus, for example, should the width W of the deep channel 250 be 2 mm, then the depth of the deep channel at that location would be at least 4 mm. Advantageously, the depth-to-width ratio of the deep channel 250 may be at least 2.5, and even at least 3, over at least 25% of the groove's length (and in some examples, over at least 50% or even over at least 75% of the groove's length). At a three-to-one ratio, a deep channel 250 having a width of 2.5 mm at a given location would have a depth of at least 7.5 mm at that same location. Very deep channels may even have a depth-to-width ratio of at least 4 or even at least 4.5, at least at some areas of the channel.

According to certain aspects, a deep channel 250 has a width that may be substantially constant along its elongated length. According to some embodiments, a deep channel 250 may have a width W of at least 0.5 mm. Such a relatively small width may result in the opposed edges of the deep channel 250 contacting one another during plantarflexion of the user's foot, thereby limiting the flexibility in the plantarflexion direction. While this may be desirable in certain circumstances and/or in some shoe designs, in other circumstances it may be preferred to not limit plantarflexion flexibility. Thus, for certain embodiments, a deep channel 250 may have a width of at least 1 mm or even of at least 1.5 mm over at least 25% of its length (and in some examples, over at least 50% or even over at least 75% of its length). A width of between 1.8 mm and 2.8 mm may provide an optimal plantarflexion gap, while at the same time not being overly soft or unstable when dorsiflexion occurs. A channel width of between 2 mm and 2.5 mm over at least 25% of its length (or even over at least 50% or at least 75% of its length) may be particular advantageous. In any event, for some sole structures, limiting the width of a deep channel 250 to less than 5 mm, less than 4 mm, or even less than 3 mm, may be preferred. Optionally, the width of the deep channel 250 may vary along its elongated length.

A deep channel 250 also may have a width that is substantially constant along the depth direction, i.e., the slot of the deep channel 250 may have substantially parallel channel sidewalls such that a cross-sectional shape of the slot is generally rectangular, as shown in FIG. 18. Optionally, the width may vary along the depth direction of the deep channel 250. For example, the slot of the deep channel 250 may have converging sidewalls moving upward toward the top of the sole 200. When the width is not constant in the depth direction, the characteristic width may be measured at the opening of the slot (i.e., at the bottom, free ends of the slot sidewalls). In some examples of this invention, a deep groove will have a bottom width W having any of the dimensional features identified above (e.g., at least 0.5 mm, at least 1 mm, at least 1.5 mm, between 1.8 mm and 2.8 mm, between 2 and 2.5 mm, less than 5 mm, less than 4 mm, less than 3 mm, etc.), and this width characteristic may apply over at least 25% of the groove's depth at the measurement location, and in some examples, over at least 50% or even over at least 75% of the groove's depth.

As illustrated in FIG. 4, deep channels 250 extend between and separate the zones 240 from one another. In this particular embodiment, the deep channels 250 include: (a) an S-shaped deep channel 250*c* that separates zones 240*a*-240*f* located in the forefoot region 11 from zone 240*g* and (b) an obliquely-angled deep channel 250*d* that separates zone 240*h* from zone 240*g*. Additional deep channels 250 located in the forefoot region 11 separate the zones 240*a*-240*f* from each other. Deep channels 250*a*, 250*b* and 250*f* extend transversely from the lateral edge 17 toward the medial edge 18 of the sole structure 200. Deep channels 250*a* and 250*b* extend completely across the forefoot region 11 of the sole structure 200 from the lateral edge 17 to the medial edge 18. Deep channel 250*f* extends from the lateral edge 17 and intersects S-shaped deep channel 250*c*. Even further, zone 240*b* is separated from zone 240*c* by deep channel 250*e*. Similarly, deep channel 250*e* also separates zone 240*d* from zone 240*e*.

Deep channel 250*e* extends in a generally longitudinal direction in the forefoot region 11 of sole structure 200. Further, deep channel 250*e* is located in the lateral side of the forefoot region 11 and is spaced from and generally follows the curvature of the lateral edge 17. In the particular embodiment of FIG. 4, deep channel 250*e* intersects and crosses over deep channels 250*a*, 250*b* and 250*f*. Further, deep channel 250*e* does not extend to the perimeter edge 208 of the sole structure 200, nor does it extend to the S-shaped deep channel 250*c*. Rather, the ends of deep channel 250*e* are "isolated" within the sole structure 200 (terminating at one end in zone 240*a* and at the other end in zone 240*f*).

Each of the zones 240 is this example embodiment is separated from its adjacent zones 240 by one or more deep channels 250. For example, forefoot toe zone 240*a* is completely separated from zones 240*b* and 240*c* by deep channel 250*a*. As another example, zone 240*b* is completely separated from zones 240*a*, 240*c* and 240*d* by deep channels 250*a*, 250*b* and 250*e*. As even another example, zone 240*e* is completely separated from adjacent zones 240*c*, 240*d*, 240*f* and 240*g* by deep channels 250*b*, 250*c*, 250*e* and 250*f*. As a further example, zone 240*g* is completely separated from adjacent zones by the S-shaped deep channel 250*c* and the obliquely-angled deep channel 250*d*. In other embodiments, one or more of the deep channels 250 may demarcate the adjacent zones from one another. Further, in other embodiments, additional, fewer, and/or different zones 240, which are demarcated or separated by deep channels 250, may be provided.

Still referring to FIG. 4, zone 240*a* is located in the forefoot region 11, more specifically in a phalange region 11*a*, and even more specifically in a distal phalange region. Deep channel 250*a* is positioned to facilitate flexing of a user's distal phalanges relative to the user's proximal phalanges. As such, deep channel 250*a* extends transversely across the sole structure 200 generally in the region associated with the joint between the distal and proximal phalanges.

Zones 240*b* and 240*c* also are located in the forefoot region 11, more specifically in a phalange region 11*a*, and even more specifically in the proximal phalange region. Deep channel 250*b* is positioned to facilitate flexing of a user's proximal phalanges relative to the user's metatarsals. As such, deep channel 250*b* extends transversely across the sole structure 200 generally in the region associated with the joint between the proximal phalanges and the metatarsals.

Zones 240*d* and 240*e* also are located in the forefoot region 11, more specifically in a lateral portion of the metatarsal region 11*b*, and even more specifically, extending over a lateral portion of the sesamoidal region 11*c*. Zone 240*f* is located in the forefoot region 11 (and optionally somewhat into the midfoot region, if desired), more specifically in a lateral portion of the metatarsal region 11*b* that extends between the sesamoidal region 11*c* and the midfoot region 12.

Thus, zones 240*a*-240*f* may cover or extend to support a majority of the forefoot region 11, but they need not extend completely over the entire forefoot region 11. As shown in the embodiment of FIG. 4, the S-shaped deep channel 250*c* generally may extend transversely along the distal end region of the first and second metatarsals, down along the third metatarsal region, and then transversely along the proximal end region of the fourth and fifth metatarsals. As such, the S-shaped deep channel 250*c* may provide a flex line that separates one or more zones located on a lateral side of the metatarsal region 11*b* from one or more zones located on a medial side of the metatarsal region 11*b*. In this instance, zones 240*d*, 240*e* and 240*f* located on the lateral side of the metatarsal region 11*b* are separated from zone 240*g* located on the medial side of the metatarsal region 11*b*.

Zone 240*g* is located in the forefoot region 11, in the midfoot region 12, and in the heel region 13 and extends continuously from the S-shaped deep channel 250*c* to the obliquely-angled deep channel 250*d* and to the back edge 15 of the sole structure. Further, zone 240*g* extends continuously from the lateral edge 17 to the medial edge 18, especially in the midfoot region 12. More specifically, zone 240*g* extends over or encompasses the medial side region of the metatarsal region 11*b*. In this particular embodiment, zone 240*g* also extends over the medial side region of the sesamoidal region 11*c*. Zone 240*g* also extends over the entire midfoot region 12. Further, zone 240*g* extends over the lateral side of the heel region 13.

Zone 240*h* is located in the heel region 13 and extends over a majority of the medial side of the heel region 13. Zone 240*h* is completely separated from adjacent zone 240*g* by the obliquely-angled deep channel 250*d* that extends from a perimeter portion along the heel edge 15 to a perimeter portion along the medial edge 18. Deep channel 250*d* is positioned to facilitate the decoupling of the medial side of the heel region from the lateral side of the heel region and from the midfoot region 12. Deep channel 250*d* extends generally longitudinally in a distal direction from the center of the back edge 15 of the sole structure 200 to a point under the user's talus and then obliquely (in a medial and distal direction) toward the navicular. According to certain embodiments, the medial-side end of deep channel 250*d* may be located approximately in the joint region of the navicular with the first cuneiform. As such, the medial-side end of deep channel 250*d* may lie in the midfoot region 12. According to other embodiments, the medial-side end of deep channel 250*d* may be located approximately in the joint region of the navicular with the talus. As such, the medial-side end of deep channel 250*d* may lie proximate the boundary between the heel region 13 and the midfoot region 12. The oblique angle defined by deep channel 250*d* may range from 100° to 170°, and in some examples, from 120° to 160°. Deep channel 250*d* may contribute to the stability of the sole member (e.g., slows down movement).

According to other aspects, any given zone 240 further may include additional secondary channels or grooves 222 and/or sipes. Thus, for example, referring to FIG. 4, a first secondary channel 222*a* may be located in the forefoot region 11 between and parallel to deep channel 250*a* and deep channel 250*b*. This first secondary channel 222*a* may extend across and intersect the generally longitudinally extending deep channel 250*e*. Further, the first secondary channel 222*a* may be approximately centered between the lateral side 17 and the medial side 18, but it need not extend all the way to the perimeter edges 208 of the sole structure 200. A second secondary channel 222*b* also is shown located in the forefoot region 11, but this secondary channel 222*b* is located between and generally parallel to deep channel 250*b* and deep channel 250*f*. This second secondary channel 222*b* extends across and intersects the generally longitudinally extending deep channel 250*e* and is approximately centered on the deep channel 250*e*. This second secondary channel 222*b* also does not extend all the way to the perimeter edges 208 of the sole structure 200 (nor does it extend all the way to S-shaped channel 250*c*).

Secondary channels 222 may extend only partially through the platform 210 and/or the tread layer 220. A "secondary channel" (or "secondary groove") may refer to a groove or channel that does not have depth and/or width features associated with deep grooves, as described above. As some more specific examples, a "secondary channel" or "secondary groove" may refer to a groove or channel having a maximum depth of more than 20% and less than 50% of the thickness of the sole member 200 over at least 50% of its length (groove depth and sole member thickness being measured as described above with respect to the deep grooves or channels 250). In other words, in some structures, a secondary channel 222 may not extend as deeply into the platform 210 as does a deep channel 250 over at least 50% of its length and will have an $H_3/T_3$ ratio of greater than 0.2 and less than 0.5 over at least 50% of its length (see FIG. 18). Additionally or alternatively, in some structures, a secondary channel may have the same depth features as a primary channel over at least some of its length (or even over its entire length), as described above, but a smaller width than a primary channel (e.g., less than 0.5 mm over at least 75% of its longitudinal length and/or over at least 75% of its depth at the measurement location). Secondary channels may be provided at areas of the sole structure to enhance dorsi-flexion while limiting or without substantially enhancing plantar-flexion. In an alternative embodiment, the secondary channels 222*a* and/or 222*b* shown in FIG. 4 may be replaced by deep channels.

A secondary channel 222 may extend partially or completely across the sole structure 200 from one portion of the perimeter edge 208 to another portion of the perimeter edge 208. Thus, according to some aspects, a secondary channel 222 optionally may be characterized as extending completely across the sole structure 200 from one portion of the perimeter edge 208 to another portion of the perimeter edge 208. According to other aspects, a secondary channel 222 may be characterized as extending through the perimeter walls or sidewalls of the sole structure 200. While secondary channels 222 may extend into two or more zones 240, e.g., across at least one deep groove 250 as shown in FIG. 4, if desired, a secondary channel may start and end in the same zone 240.

The various zones 240 of the sole structure 200 may be provided with a structural configuration designed to accommodate predetermined pressure loading, e.g., impact loads experienced during specific skateboarding tricks or movements. U.S. patent application Ser. No. 13/556,872, filed Jul. 24, 2012 to Cortez, et al., and titled "Sole Structure for an Article of Footwear" discloses certain such structural configurations and is herein incorporated in its entirety by reference. Thus, for example, the sole structure 200 may include at least one zone 240 having a multi-regime pressure load versus displacement response system as disclosed in U.S. patent application Ser. No. 13/556,872. As a specific example, one or more zones 240 of the sole structure 200 may have a zigzag or undulating tread configuration (e.g., having a generally herringbone shaped appearance) that is designed to "buckle" under a predetermined loading while continuing to absorb appreciable amounts of impact energy. As such, the sole structure 200 may limit the peak loads experience by the user. In operation, as the tread configuration of sole structure 200 is initially compressed, energy is absorbed by the structure's impact-attenuation system. As the tread configuration is compressed even more, additional energy is absorbed by the system. For high-impact loading, it would be desirable to have a significant amount of energy absorbed by the system without the user's foot experiencing high impact loads. The referenced impact-attenuation system provides a mechanism to absorb energy while at the same time minimizing or ameliorating the loads experienced by a user during the impact. Additionally, the multi-regime impact-attenuation system may absorb significant amounts of energy, for example, as compared to conventional foamed midsoles with conventional outsoles, while minimizing or reducing the loads experienced by the user during an impact event. A multi-regime (pre-buckled/buckled/post-buckle) tread configuration may be provided as part of the platform 210 and/or as part of the tread layer 220.

Alternatively or additionally, other more conventional tread configurations may be provided within the zones 240. These additional conventional tread configurations, when present, may be unitarily formed with the platform 210, or these additional conventional tread configurations may be made from different and/or separate pieces of material, e.g., a separately formed tread layer 220 that is then cemented or otherwise engaged with the lower surface of the platform 210. Further, the tread configuration or other ground-contacting configuration need not be the same within multiple zones 240 of a single sole member 200. Any given zone 240 may accommodate multiple ground-contacting tread configurations, tread layers, materials, etc. At least some zones 240 may have a tread layer 220 or other traction element formed as a herringbone, zig-zag, or undulating type tread configuration.

According to certain aspects, the forefoot region 11 and specifically the region of the forefoot encompassed by zones 240*a*-240*f* may be configured to enhance flexibility or dexterity. This flexibility or dexterity may be developed via the deep channels 250, the configuration of the ground-contacting surface, including secondary channels 222 (if any), the material of the platform 210, the material of the separate tread layer 220 (if any), etc. The deep channels and/or other features of these zones may be designed to enhance plantarflexion (e.g., relatively wide, deep channels, as described above).

In contrast, according to certain aspects, other regions of the sole structure 200 may be configured to be stiffer and/or to enhance energy transfer (e.g., to react to significant impact loads and/or to develop significant restoring forces). Thus, for example, in accordance with certain embodiments and referring to FIG. 4, the midfoot region 12 may be devoid of deep channels 250. In accordance with other embodiments and by way of non-limiting examples, the medial-side of the metatarsal region 11*b* may be devoid of deep channels 250; the lateral-side of the midfoot region 12 may be devoid of deep channels 250; the medial-side of the midfoot region 12 may be devoid of deep channels 250; the lateral-side of the heel region 13 may be devoid of deep channels 250; the medial-side of the heel region 13 may be devoid of deep channels 250; etc. In accordance with these non-limiting examples, deep channels 250 may demarcate and/or separate the various regions that are devoid of deep channels 250. Thus, for example, deep channel 250*d* separates a medial-side of the heel region 13 that is devoid of deep channels 250 from the other portions of the sole structure 200.

Optionally, the various regions of the sole structure 200 may be grouped together to form a continuous zone with one or more of the adjacent regions. Thus, for example, as shown in FIG. 4, a group encompassing the medial-side of the metatarsal region 11*b*, the lateral-side of the midfoot region 12, the medial-side of the midfoot region 12, and the lateral-side of the heel region 13 may, in their entirety, be devoid of deep channels 250.

Similarly, in accordance with certain embodiments, specific regions or groupings of regions may be devoid of secondary channels 222. Thus, as shown in FIG. 4, zone 240*g* may encompass a group formed from the medial-side of the metatarsal region 11*b*, the lateral-side of the midfoot region 12, the medial-side of the midfoot region 12, and the lateral-side of the heel region 13 which may, in their entirety, be devoid of secondary channels 222. The lack of secondary channels 222 within zone 240*g* may contribute to the overall stiffness or feel of this zone. It may be particularly advantageous to provide a midfoot region 12 that has no deep channels 250 and no secondary channels 222. Further, it may be preferable to provide a zone that encompasses the midfoot region 12 and the medial side of the metatarsal region 11*b*, which zone is devoid of deep channels 250 and secondary channels 222 within the zone.

According to other aspects, certain zones 240 may be configured to be thin and relatively light weight to enhance the "feel." Thus, according to certain embodiments, each of the various sole portions or zones 240 may be tailored to provide different properties (impact-attenuation, flexibility, support, elasticity, traction, weight, "feel," etc.). In this way, the sole structure 200 may be tailored to the expected conditions of use.

Figure 3:
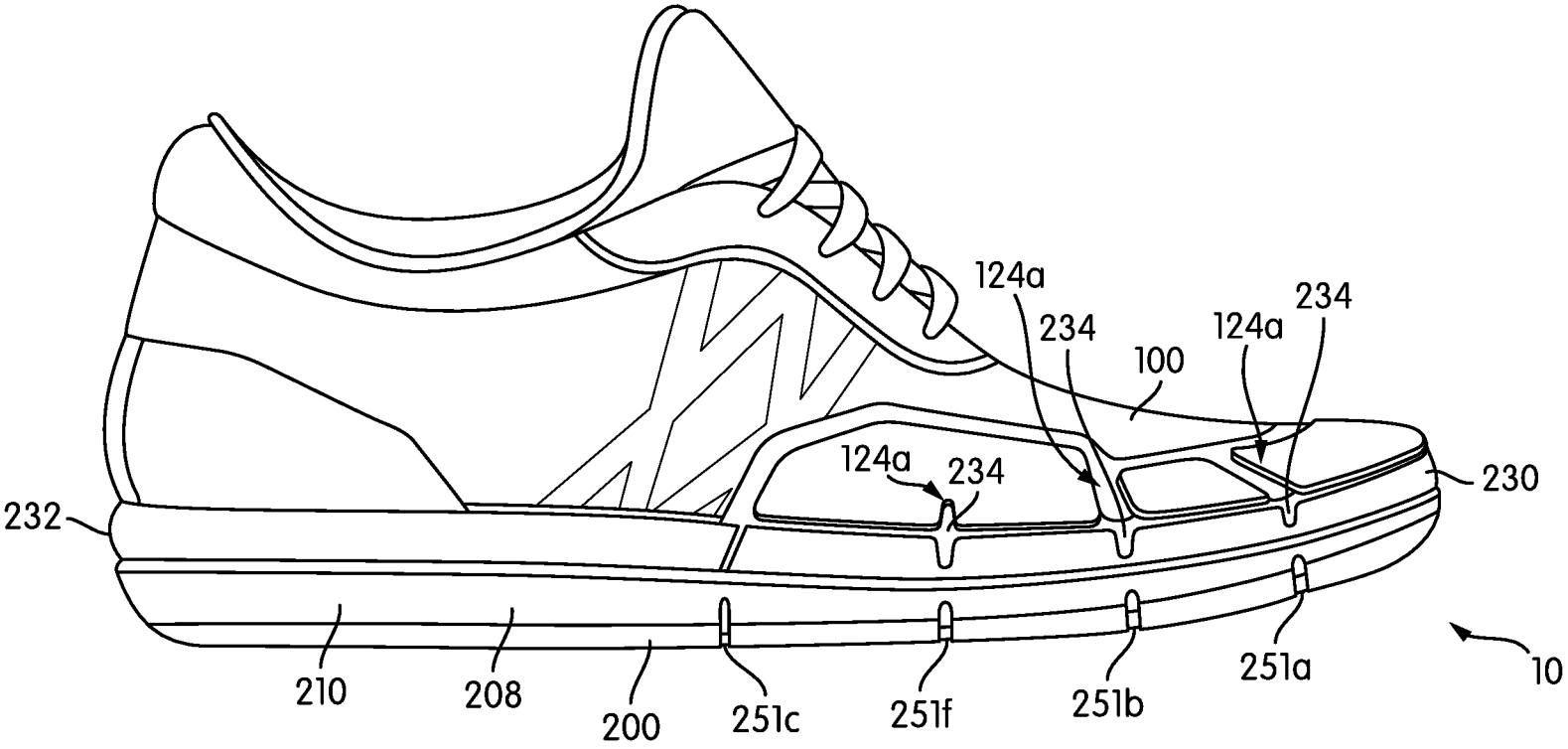
FIG. 3 is a lateral side view of the article of footwear of FIG. 1.

In the particular embodiment of FIG. 4, the elongated S-shaped deep channel 250*c* extends from a lateral-side end 251*c* to a medial-side end 253*c*. The elongated S-shaped channel 250*c* may extend continuously from the lateral edge 17 of the sole structure 200 to the medial edge 18 of the sole structure 200. In other words, both the lateral-side end 251*c* and the medial-side end 253*c* may be located on a perimeter edge 208 of the sole structure 200. As best shown in FIG. 1, the medial-side end 253*c* extends through the perimeter wall 208 of the platform 210. As best shown in FIG. 3, the lateral-side end 251*c* extends through the perimeter wall 208 of the platform 210.

Further, the elongated S-shaped deep channel 250*c* may lie completely within the forefoot region 11 of the sole structure 200. On the medial side of the sole structure 200, the elongated S-shaped deep channel 250*c* may have a concave curvature at its distal end that faces the medial edge 18 of the sole structure 200. On the lateral side of the sole structure 200, the elongated S-shaped deep channel 250*c* may have a concave curvature at its proximal end that faces the lateral edge 17 of the sole structure 200. In this particular embodiment, the elongated S-shaped deep channel 250*c* transitions in the region of the third metatarsal (see also FIG. 11) from the lateral-facing concave curvature forming its proximal portion to the medial-facing concave curvature forming its distal portion. In other words, an inflexion point of the S-shaped deep channel 250*c* may be located near the third metatarsal region. Advantageously, an inflexion point of the S-shaped deep channel 250*c* may be located in a region generally associated with the midpoint of the third metatarsal.

According to certain embodiments, on the medial side of the sole structure 200, the elongated S-shaped channel 250*c* generally may extend beneath the joint region between the first proximal phalange region and a first metatarsal region. For purposes of this disclosure, a "joint region" includes a region associated with the immediate contact area of the bones being joined and further includes the enlarged regions of the bones being joined. Thus, for example, the joint regions of the proximal phalanges to the metatarsals include the sesamoidal regions of the metatarsals. On the lateral side of the sole structure 200, the elongated S-shaped channel 250*c* may extend beneath the region associated with the proximal half of the fourth and fifth metatarsals. Further, the elongated S-shaped channel 250*c* may extend beneath the third metatarsal in the region associated with the middle third of the third metatarsal.

For purposes of this disclosure and referring also to FIG. 11, a sole length L may be the heel-to-toe longitudinal distance from the back edge 15 to the front edge 14 along the longitudinal centerline 16. When the sole length L is "partitioned" into halves, thirds, quartiles, quintiles, etc., the first half, first third, first quartile, etc., is located nearest the back edge 15.

According to certain aspects, the lateral-side end 251*c* of the elongated S-shaped channel 250*c* may be located in a middle third of the sole length. In accordance with some embodiments, the lateral-side end 251*c* of the elongated S-shaped channel 250*c* may be located in a third quintile (40-60) of the sole length L. In accordance with other embodiments, the lateral-side end 251*c* of the elongated S-shaped channel 250*c* may be located in a third sextile of the sole length L. In accordance with even other embodiments, the lateral-side end 251*c* of the elongated S-shaped channel 250*c* may be located in a region generally associated with a user's cuboid-to-fifth-metatarsal joint region.

According to certain aspects, the medial-side end 253*c* of the S-shaped deep channel 250*c* may be located in an upper third of the sole length L. According to some embodiments, the medial-side end 253*c* of the S-shaped deep channel 250*c* may be located in a fourth quintile of the sole length. According to other embodiments, the medial-side end 253*c* of the S-shaped deep channel 250*c* may be located in a fifth sextile of the sole length L. In accordance with even other embodiments, the medial-side end 253*c* of the elongated S-shaped channel 250*c* may be located in a region generally associated with a user's phalange-to-first-metatarsal joint region.

According to some aspects, and still referring to FIGS. 4 and 11, the elongated S-shaped channel 250*c* may cross over the longitudinal centerline 16 of the sole in a middle third of the sole length L. Even further, according to certain embodiments, the elongated S-shaped channel 250*c* may cross over the longitudinal centerline 16 of the sole in a third quintile of the sole length L. According to other embodiments, the elongated S-shaped channel 250*c* may cross over the longitudinal centerline 16 of the sole in a fourth sextile of the sole length. Further in the particular embodiment shown in FIG. 4, deep channel 250*b* extends transversely to the longitudinal axis 16 from a lateral-side end 251*b* to a medial-side end 253*b*. Of particular note in this embodiment, a medial portion of deep channel 250*b* merges with the medial portion of deep channel 250*c*. Essentially, the medial portion of transversely-extending deep channel 250*b* becomes coextensive with the medial portion of the S-shaped deep channel 250*c*. As best shown in FIG. 1, the medial-side end 253*b* of deep channel 250*b* extends through the perimeter wall 208 of the platform 210. Because deep channel 250*b* merges with deep channel 250*c* in this embodiment, medial-side end 253*b* is coincident with medial-side end 253*c*. As best shown in FIG. 3, the lateral-side end 251*b* extends through the perimeter wall 208 of the platform 210.

FIGS. 5-7 illustrate an embodiment similar to the embodiment of FIGS. 1-4, in that deep channels 250*a*, 250*b*, 250*c*, 250*d*, 250*e* and 250*f* all are provided in the bottom of the platform 210. Further, in the embodiment of FIGS. 5-7 additional deep channels 250*g* and 250*h* are provided. These deep channels 250*g*, 250*h* are provided where the secondary channels 222*a*, 222*b* are provided in the embodiment of FIGS. 1-4.

As described above, the embodiment of FIGS. 5-7 also includes a forefoot sidewall component 230 that extends over the entire forefoot perimeter. This forefoot sidewall component 230 may include notches 234, 236 that are aligned with one or more of the ends 251, 253 of one or more of the deep channels 250. As best shown in FIG. 5, notches 234, 236 are generally vertically aligned with the ends of the deep channels 250. Notches 234 are formed in the upper, exterior edge of sidewall component 230; notches 236 are formed in the lower, interior edge or flange of sidewall component 230. Notches 234 and notches 236 may allow the sidewall component 230 to flex and to more easily conform to the greater degree of flexure experienced by the platform 210 due to the deep channels 250. As shown in FIGS. 5-7, notches 234 may be relatively deep, extending at least approximately 50% into the sidewall's vertical depth Similarly, notches 236 may be relatively deep, extending at least approximately 50% into the lower flange's horizontal width. Notches 234 are shown as being relatively narrow, whereas notches 236 are shown as being relatively wide, V-shaped notches. Notches 234 also are shown in FIGS. 1 and 3 and in the embodiment of FIG. 8.)

Figure 8:
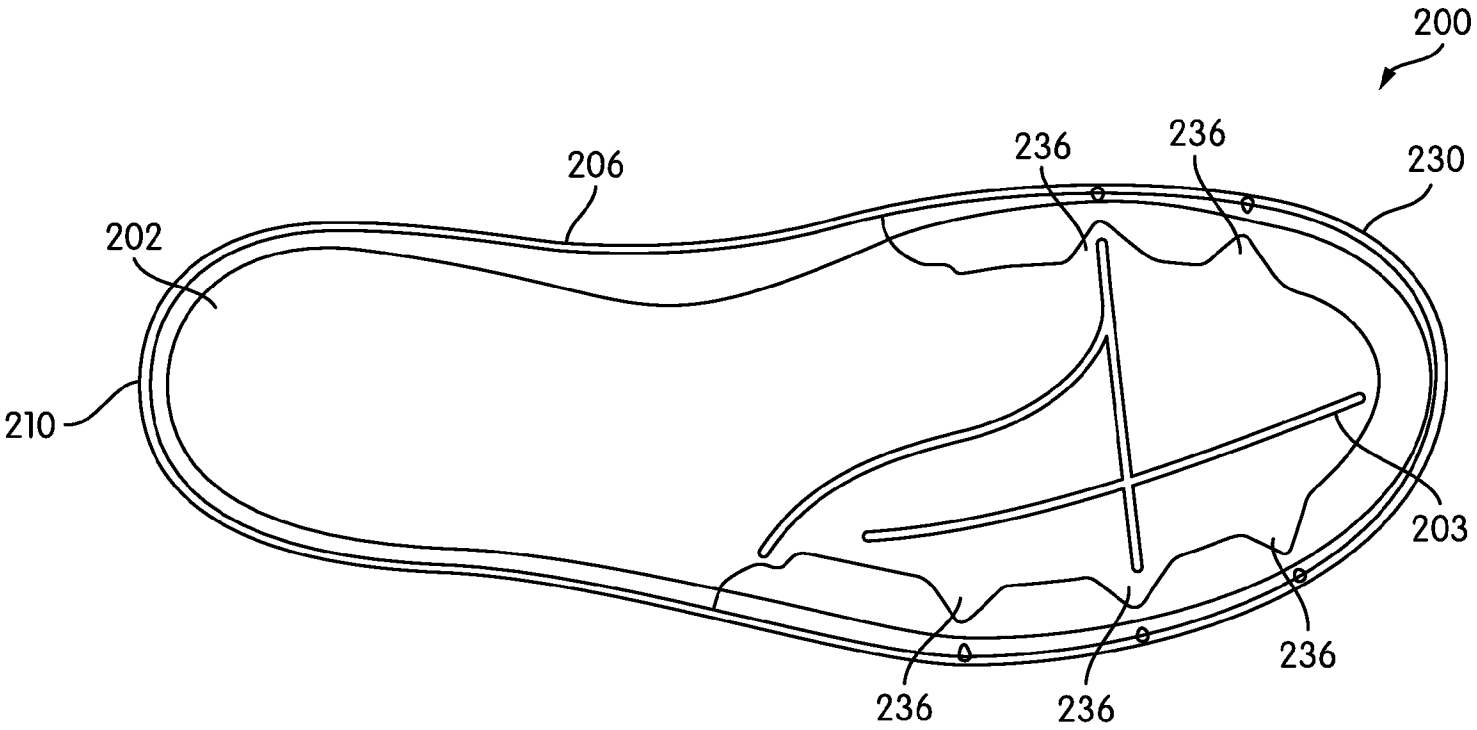
FIG. 8 is a top view of an alternative embodiment of a sole structure for an article of footwear in accordance with aspects of this disclosure.

FIG. 8 further illustrates that the upper surface 202 of the platform 210 may be provided with indentations 203 that may be aligned with one or more of the deep channels 250 formed in the lower surface 204 of the platform 210. Indentations 203 may be formed as molded or machined slots or grooves. These indentations 203 may allow the platform 210 to flex more easily to conform to the greater degree of flexure experienced due to the deep channels 250. These indentations 203 may be provided over some, all or none of the deep channels 250. Thus, for the example structure shown in FIG. 8, indentations 203 are provided over deep channels 250*c*, 250*b* and 250*e*.

Figure 9:
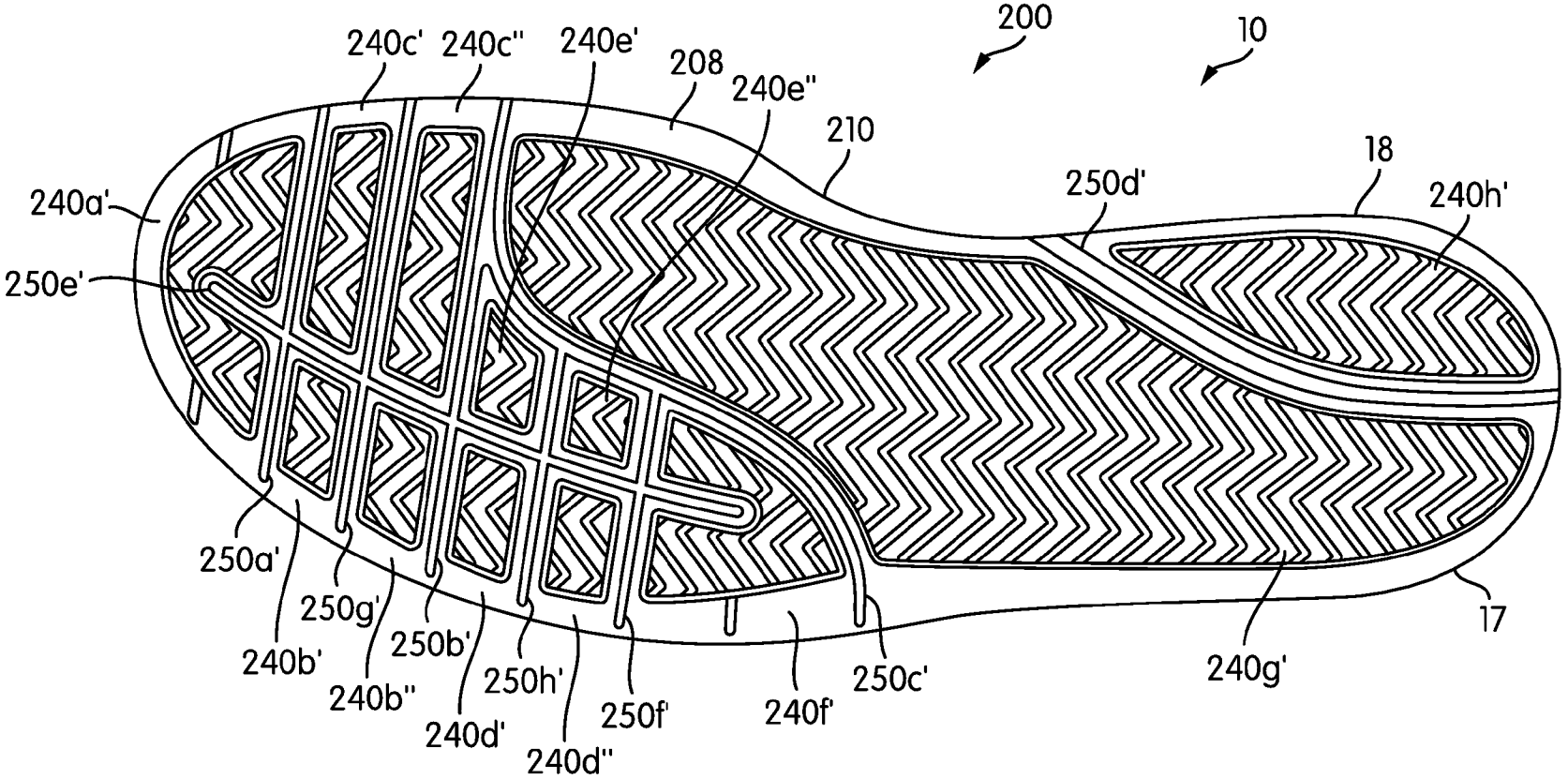
FIG. 9 is a bottom view of the alternative embodiment of a sole structure for an article of footwear in accordance with aspects of this disclosure.
Figure 10:
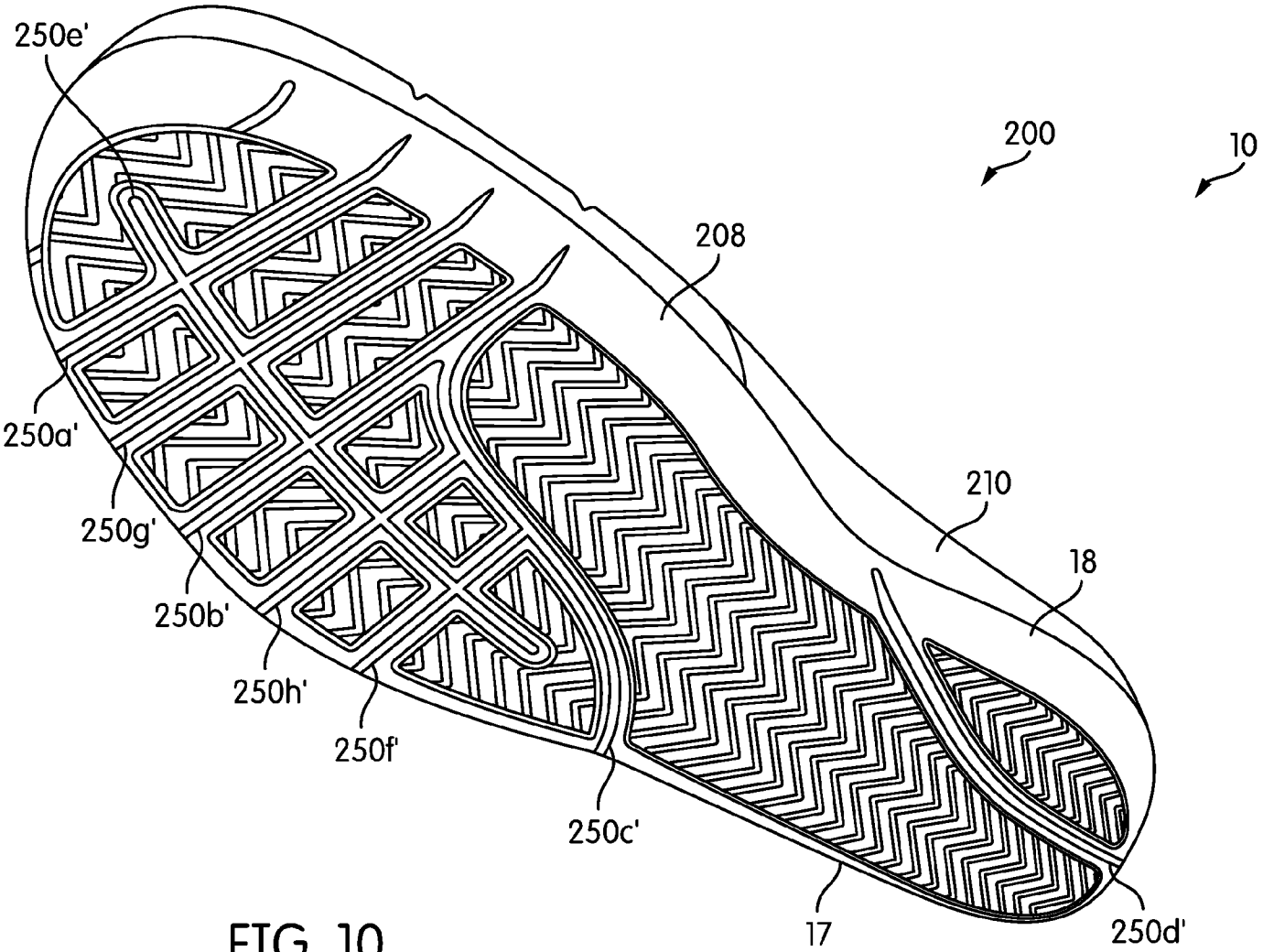
FIG. 10 is a perspective view, looking from the bottom, of the sole structure of FIG. 9.

FIGS. 9-10 illustrate a sole structure 200 provided with deep channels 250*a*', 250*b*', 250*c*', 250*d*', 250*e*', 250*f*, 250*g*' and 250*h*'. Deep channels 250*a*', 250*b*', 250*c*' and 250*g*' extend completely across the width of the sole structure 200, from the lateral side 17 to the medial side 18. Each of these deep channels also extends completely through the perimeter sidewall 208 of the platform 210. Deep channels 250*h*' and 250*f* extend from the lateral side 17 toward the center of the sole structure 200 where they intersect with the S-shaped deep channel 250*c*'. Deep channel 250*e*' extends longitudinally in the lateral portion of the forefoot region 11, with a slight convex curvature facing the lateral side 17. Zones 240*a*', 240*b*', 240*b*", 240*c*', 240*c*", 240*d*', 240*d*", 240*e*', 240*e*", 240*f*, 240*g*' and 240*h*' are completely separated from one another by the deep channels. Zones 240*a*', 240*b*', 240*b*", 240*c*', 240*c*", 240*d*', 240*d*", 240*e*', 240*e*", and 240*f* have a tread layer that is integrally formed with the remainder of the platform 210. Zones 240*g*' and 240*h*' have tread layers formed separately from the platform 210 and then subsequently attached thereto (e.g., by adhesives or cements, by co-molding or in-molding, etc.).

Other embodiments are shown in FIGS. 12A-12D. Thus, referring to FIG. 12A, a deep channel 250 may be provided within the metatarsal region 11*b*, wherein a lateral end 251 of the deep channel is located in a region associated with the proximal end of a user's fifth metatarsal and wherein a medial end 253 of the deep channel is located in a region associated with the distal end of a user's first metatarsal. This deep channel 250 may be smoothly curved and S-shaped. The S-shape may be relatively deeply curved or relatively shallowly curved. Optionally, this deep channel 250 within the metatarsal region 11*b* may be linear or piecewise linear. Alternatively, the metatarsal deep channel 250 may extend in a straight line from the lateral end 251 of the deep channel (located near the proximal end of the fifth metatarsal) to the medial end 253 of the deep channel (located near the distal end of the first metatarsal).

Figure 12A:
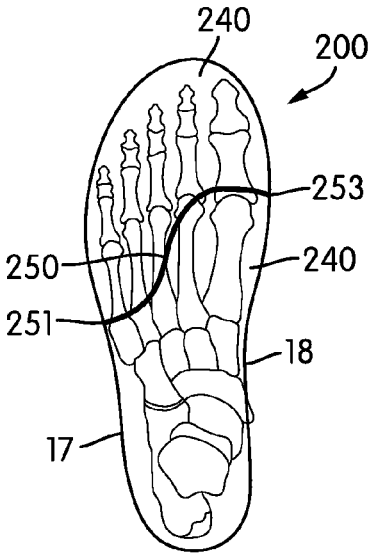
FIGS. 12A-12D show various embodiments and variations of deep channels in sole structures in accordance with aspects of this invention.
Figure 12B:
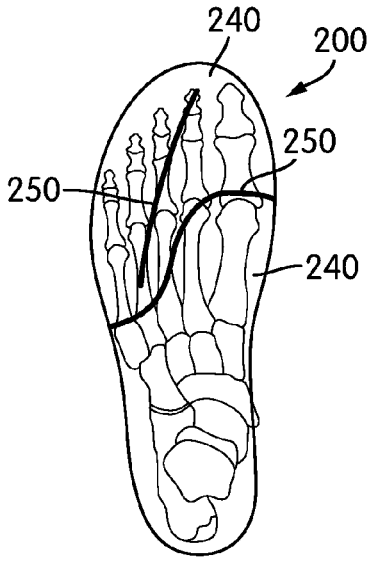

Referring to FIG. 12B, in addition to the S-shaped deep channel 250 associated with a user's metatarsal region 11*b* (e.g., having any of the variations mentioned above), a generally longitudinally extending deep channel 250 associated with the lateral side of the forefoot portion 11 is also provided. This longitudinal channel does not extend to the perimeter edges of the sole structure and/or to the S-shaped deep channel 250 (although it may do so, if desired).

Figure 12C:
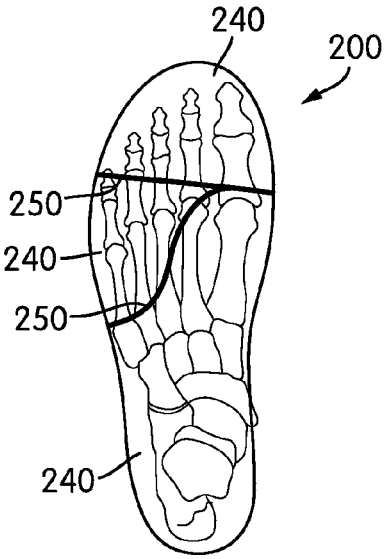

Referring to FIG. 12C, in addition to the S-shaped deep channel 250 associated with a user's metatarsal region 11*b* (e.g., having any of the variations mentioned above), a generally transversely extending deep channel 250 extends from the lateral side to the medial side, adjoining with the lateral-side end of the S-shaped deep channel.

Figure 12D:
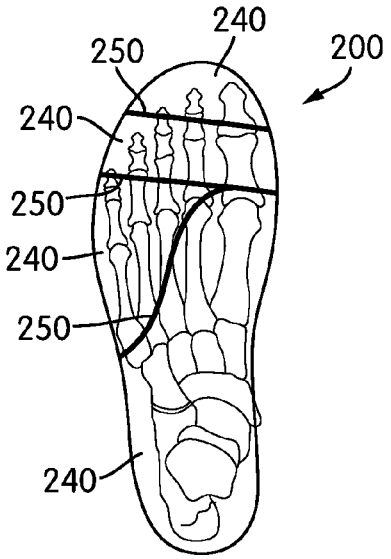

Referring to FIG. 12D, in addition to the deep channels shown in FIG. 12C (e.g., having any of the variations mentioned above), a further generally transversely extending deep channel 250 extends across the distal portion of the phalanges.

In all of FIGS. 12A-12D, a metatarsal deep channel 250 may be provided within the metatarsal region 11*b*, wherein a lateral end of the deep channel is located near the proximal end of the fifth metatarsal and wherein a medial end of the deep channel is located near the distal end of the first metatarsal. The metatarsal deep channel 250 may be smoothly curved and S-shaped. The S-shape may be relatively deeply curved or relatively shallowly curved. Optionally, the metatarsal deep channel 250 may be linear or piecewise linear. In the simplest instance, the metatarsal deep channel 250 may extend in a straight line from the lateral end of the deep channel (located near the proximal end of the fifth metatarsal) to the medial end of the deep channel (located near the distal end of the first metatarsal).

The deep channel(s) 250 and/or the secondary channel(s) 222 (if any) may be provided in the sole structure 200 in any desired manner. As one non-limiting example, the deep channel(s) 250 and/or secondary channel(s) 222 may be directly formed in the platform 210 during its manufacture (e.g., molded into the bottom surface of platform 210). As another example, the channel(s) 250 and/or 222 may be formed by cutting them into the bottom surface of the platform 210 (e.g., hot knife cutting, laser cutting, etc.). The tread layer(s) 220 may be glued or otherwise fixed into shallower recesses 210*r* formed in the bottom of the platform 210 adjacent the channel(s) 250 and/or 222 (e.g., see FIG. 7). The tread layer(s) 220, if any, may be located adjacent, but preferably not overlapping with channel(s) 250 and/or 222, in order to maintain more flexibility due to the channel(s) 250 and/or 222.

The various components of sole structure 200 (e.g., platform 210, tread layer(s) 220, perimeter member(s) 230, etc.) may be formed of conventional footwear sole materials, such as natural or synthetic rubber, polymeric foams, thermoplastic polyurethanes, etc., including combinations thereof. The material may be solid, foamed, filled, etc., or a combination thereof. One particular rubber may be a solid rubber having a Shore A hardness of 65-85. Another particular composite rubber mixture may include approximately 75% natural rubber and 25% synthetic rubber. The synthetic rubber could include a styrene-butadiene rubber. By way of non-limiting examples, other suitable polymeric materials for the sole structure 200, including the platform 210 and/or tread layer elements 220, include plastics, such as PEBAX® (a polyether-block co-polyamide polymer available from Atofina Corporation of Puteaux, France), silicone, thermoplastic polyurethane (TPU), polypropylene, polyethylene, ethylvinylacetate, and styrene ethylbutylene styrene, etc. Optionally, the materials of the various components of the sole structure 200 also may include fillers or other components to tailor its wear, durability, abrasion-resistance, compressibility, stiffness and/or strength properties. These auxiliary material components may include reinforcing fibers, such as carbon fibers, glass fibers, graphite fibers, aramid fibers, basalt fibers, etc.

While any desired materials may be used for the platform 210, including those mentioned above (such as rubbers, ethylvinylacetate foams, and/or polyurethane foams), in at least some examples, the material of the platform 210 may be somewhat softer than some conventional outsole materials (e.g., 50-55 Shore A rubber or other polymeric material may be used), to additionally help provide the desired stiffness and/or impact force attenuation characteristics. Optionally, if desired, a harder material (e.g., 60-65 Shore A rubber or other polymeric material) may be used in the heel region and/or in certain medial regions. The platform 210 may be made, at least in part, of materials used in the sole structures of existing NIKE footwear products sole under the FREE® brand.

Further, multiple different materials may be used to form the various components of the sole structure 200. For example, a first material may be used for the forefoot region 11 and a second material may be used in the heel region 13 of the platform 210. Alternatively, a first material may be used to form a ground-contacting tread layer 220 and a second material may be used to form the forefoot sidewall component 230 and/or the platform 210. The sole structure 200 may be unitarily molded, co-molded, laminated, adhesively assembled, etc. As one non-limiting example, the ground-contacting tread layer 220 (or a portion of the ground-contacting bottom layer) could be formed separately from the platform 210 and subsequently integrated therewith.

The separate ground-contacting tread layer 220 may be formed of a single material. Optionally, the tread layer 220 may be formed of a plurality of sub-layers. For example, a relatively pliable layer may be paired with a more durable, abrasion resistant layer. By way of non-limiting examples, the abrasion resistant layer may be co-molded, laminated, adhesively attached or applied as a coating. Additionally, material forming an abrasion resistant layer may be applied to exposed portions of the platform 210. Such material may include texturing and/or texturing elements.

Further, with respect to another aspect of this invention, at least certain components of the sole structure 200 may be provided with a grip enhancing material to further enhance traction and slip resistance. The grip enhancing material may provide improved gripping properties as the foot moves and/or rolls along the skateboard and may allow a larger area of the footwear to maintain contact with the skateboard. Thus, for example, at least some areas of the forefoot sidewall component 230 may be provided as a relatively soft rubber or rubber-like component or a relatively soft thermoplastic material, such as a thermoplastic polyurethane (TPU). In one particular embodiment, a softer durometer rubber may form an outer layer of the sidewall component 230 (e.g., a rubber having a hardness of 60 to 75 Shore A, possibly of 60 to 70 Shore A, and possibly of 64 to 70 Shore A), with a harder durometer rubber forming an inner layer (e.g., a rubber having a hardness of 70 to 90 Shore A, and possibly of 75 to 88 Shore A). Optionally, the enhanced gripping material may be co-molded, adhesively bonded, coated or otherwise provided on the sidewall component 230 and/or on other portions of platform 210.

Thus, from the above disclosure it can be seen that the enhanced impact-attenuation system due to the sole structure 200 as disclosed herein provides improved flexibility, both dorsi-flexion and planar-flexion, and better impact protection, while not sacrificing "feel" and/or "grip" on the board or other object. As some more specific examples, the illustrated sole structure 200 may provide excellent flexibility, dexterity, and/or natural motion in the forefoot toe and forefoot lateral side areas (where there are multiple deep channels and secondary channels) while providing energy transfer zones and impact force attenuation in the midfoot and heel areas.

Figure 13:
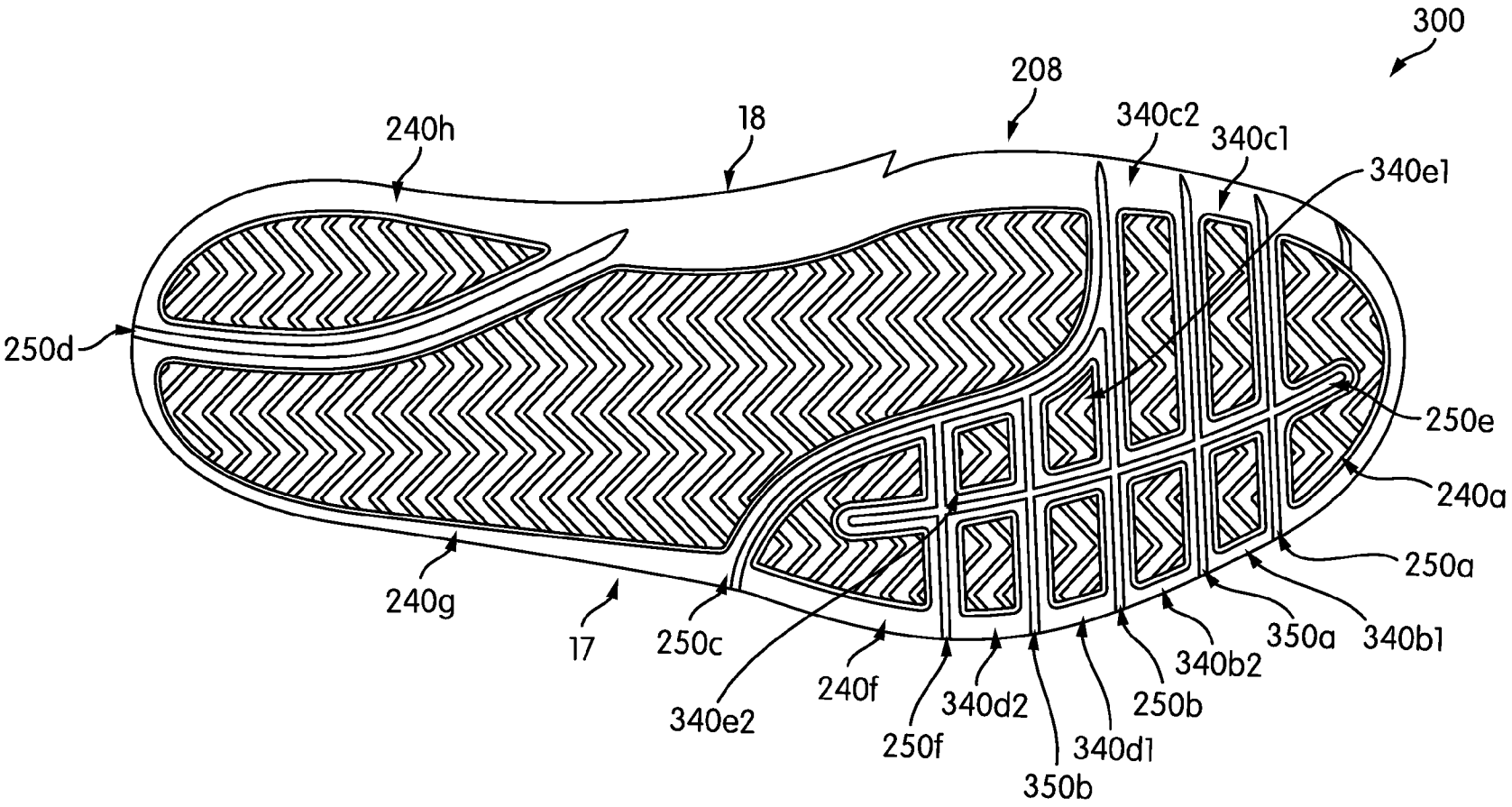
FIGS. 13-15 provide bottom views of alternative sole structures in accordance with aspects of this invention.

FIG. 13 illustrates a bottom view of a sole structure 300 that is similar to sole structure 200 described above (when the same reference numbers are used in FIG. 13 as used in other figures herein, that reference number is intended to refer to the same or similar part as those described above and associated with that reference number, including any of the various options or alternatives described above for that reference number). In this example sole structure 300, however, the secondary grooves 222*a* and 222*b* as shown in FIG. 4 are replaced with primary grooves 350*a* and 350*b*. Additionally, rather than terminating within the zones 240*b* and 240*c* in the manner shown in FIG. 4, primary groove 350*a* of this example sole structure 300 extends completely from the lateral side 17 to the medial side 18 of the sole member 300 (opening up at the medial and lateral sidewalls 208 of sole member 300). In this manner, the forefoot, lateral side area includes zones 340*b*1 and 340*b*2, and the forefoot, medial side area includes zones 340*c*1 and 340*c*2. Zone 340*b*1 is separated from the other zones by primary grooves 250*a*, 250*e*, and 350*a*, and zone 340*b*2 is separated from the other zones by primary grooves 350*a*, 250*e*, and 250*b*. Similarly, zone 340*c*1 is separated from the other zones by primary grooves 250*a*, 250*e*, and 350*a*, and zone 340*c*2 is separated from the other zones by primary grooves 350*a*, 250*e*, and 250*b*.

With respect to primary groove 350*b*, rather than terminating within the zones 240*d* and 240*e* in the manner shown in FIG. 4, primary groove 350*b* of this example sole structure 300 extends completely from the lateral side 17 of the sole member 300 (opening up at the lateral sidewall 208 of sole member 300) to the double curved groove 250*c*. In this manner, the forefoot/midfoot area at the lateral side of primary groove 250*e* includes zones 340*d*1 and 340*d*2, and the forefoot/midfoot area at the medial side of primary groove 250*e* includes zones 340*e*1 and 340*e*2. Zone 340*d*1 is separated from the other zones by primary grooves 250*b*, 250*e*, and 350*b*, and zone 340*d*2 is separated from the other zones by primary grooves 350*b*, 250*e*, and 250*f*. Similarly, zone 340*e*1 is separated from the other zones by primary grooves 250*b*, 250*e*, 350*b*, and 250*c*, and zone 340*e*2 is separated from the other zones by primary grooves 350*b*, 250*e*, 250*f*, and 250*c*.

As further shown in FIG. 13, one or more (or even all) of the zones may have a tread layer or other traction element or outsole structure provided within it (e.g., between the primary channels). While any desired tread layer may be provided, if desired, the tread layers provided in the example sole structure 300 of FIG. 13 may be herringbone, zig-zag, or undulating type tread layer configurations. Also, this example sole structure 300 could have any of the various structures, features, and/or options described above in conjunction with FIGS. 1-12D and 18.

Figure 14:
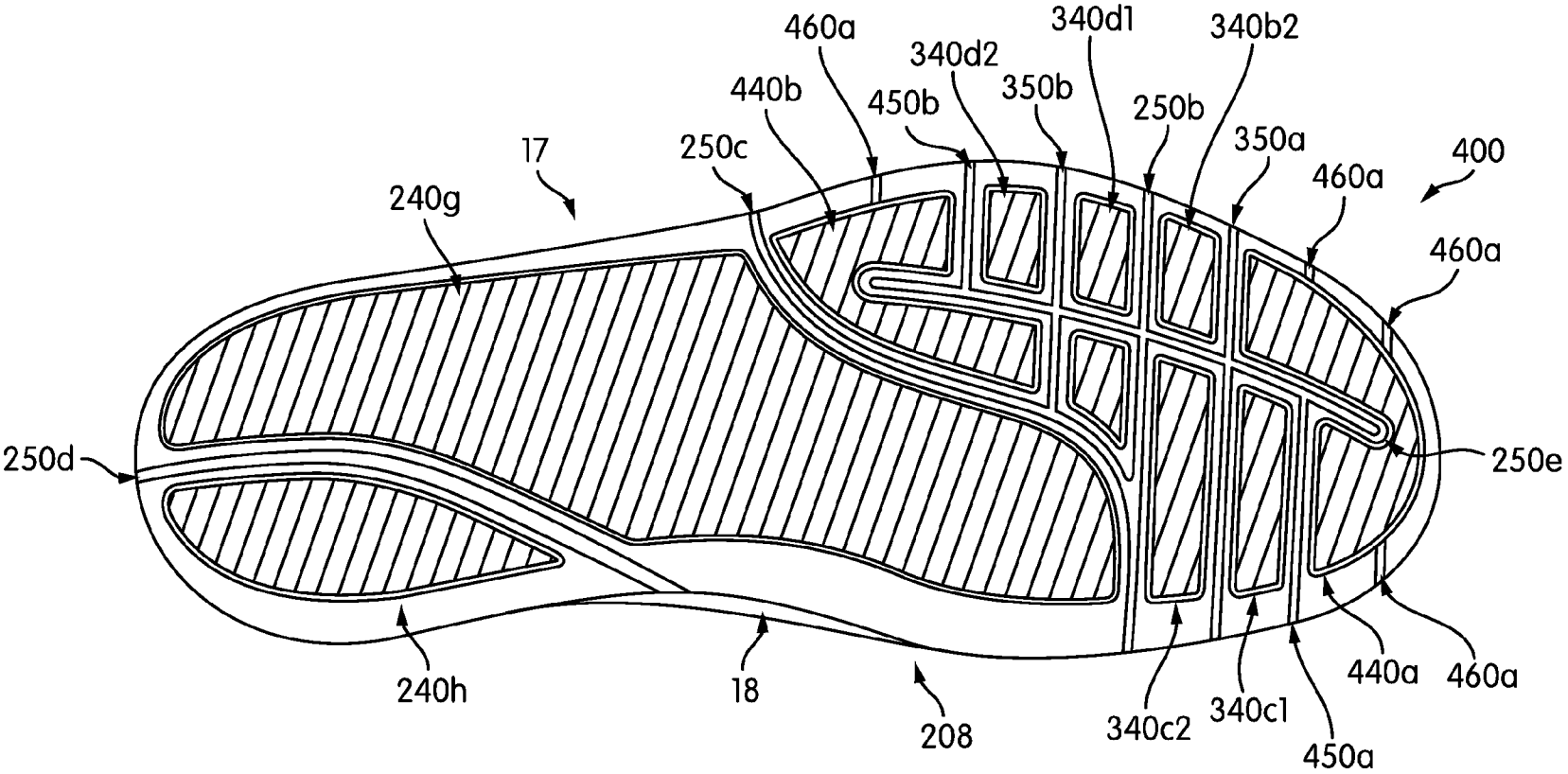

FIG. 14 shows a bottom view of another example sole structure 400 in accordance with some aspects of this invention (when the same reference numbers are used in FIG. 14 as used in other figures herein, that reference number is intended to refer to the same or similar part as those described above and associated with that reference number, including any of the various options or alternatives described above for that reference number). The structure 400 of FIG. 14 is similar to that of FIG. 13, but some of the primary channels and the zones have been changed. More specifically, in the sole structure 400 of FIG. 14, primary groove 250*a* is replaced with a shorter primary groove 450*a* that extends from the medial sidewall 208 to the primary groove 250*e*. In this manner, the forefoot toe zone 440*a* extends from primary groove 450*a* at the medial side of primary groove 250*e*, around the forward end of primary groove 250*e*, and around the lateral side of primary groove 250*e* to primary groove 350*a*. If desired, as shown in FIG. 14, one or more groove 460*a* (e.g., having primary or secondary groove characteristics) may extend from the lateral and/or medial sidewalls 208 inward, e.g., to maintain an additional level of flexibility along the sidewalls of the sole member 400.

Also, in this illustrated example sole structure 400, primary groove 250*f* is replaced with a shorter primary groove 450*b* that extends from the lateral sidewall 208 to the primary groove 250*e*. In this manner, the midfoot zone 440*b* extends from primary groove 450*b* at the lateral side of primary groove 250*e*, around the rearward end of primary groove 250*e*, and around the medial side of primary groove 250*e* to primary groove 350*b*. Optionally, if desired, in this and/or any other sole structures described herein, the longitudinal forefoot primary groove 250*e*, when present, could extend to (and optionally through) the forward toe sidewall 208 of the sole structure and/or to (and optionally opening into) the double curved primary groove 250*c*. This example sole structure 400 also could have any of the various structures, features, and/or options described above in conjunction with FIGS. 1-13 and 18.

Figure 15:
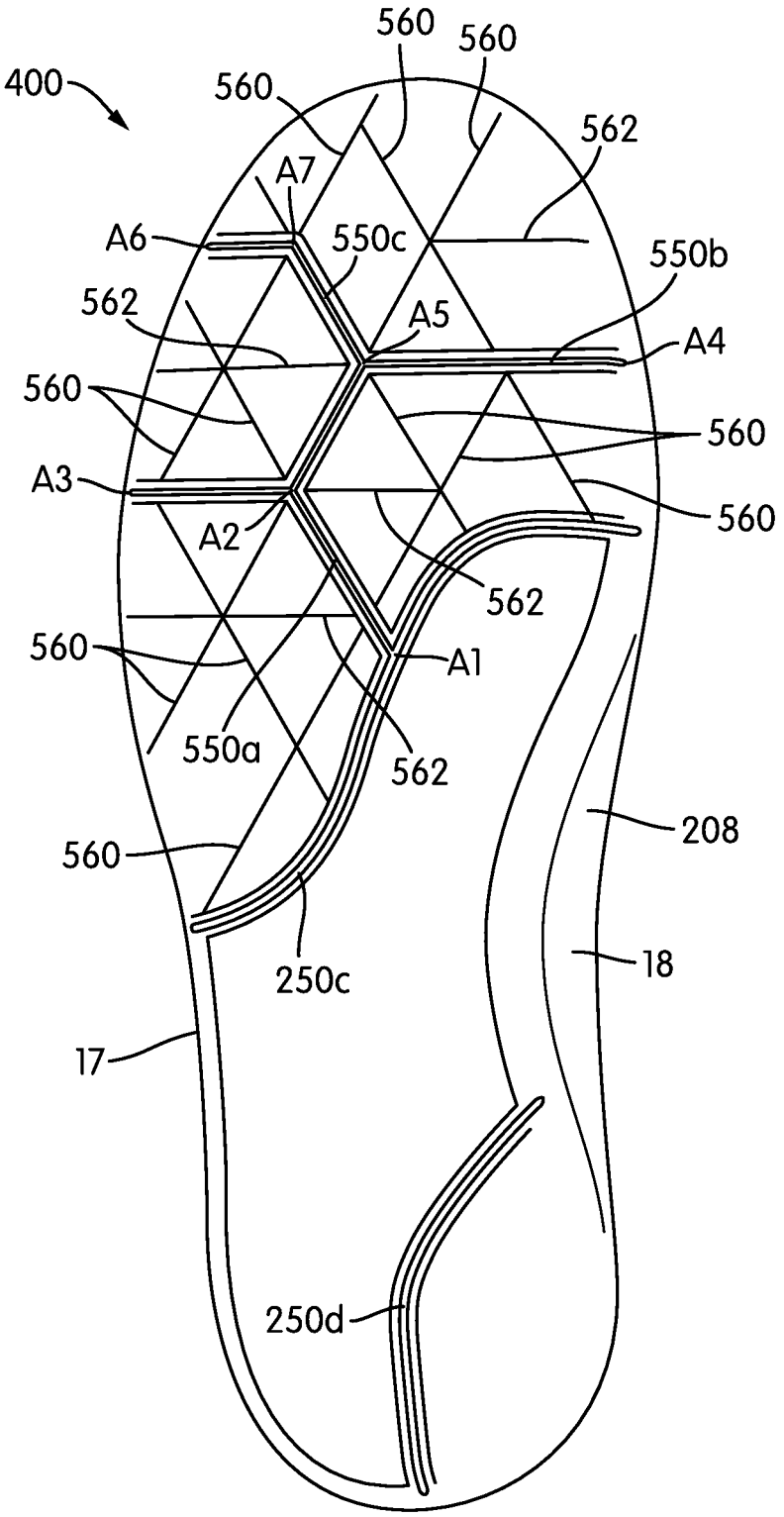

FIG. 15 illustrates a bottom view of another example sole structure 500 in accordance with at least some examples of this invention. In the other example sole structures 200, 300, and 400 described above, several of the primary and secondary grooves generally extended directly across the sole structure from the lateral side 17 to the medial side 18. This produced several zones that were generally rectangular (or four sided) in shape. Other primary and secondary groove arrangements are possible without departing from this invention. FIG. 15 illustrates an example sole structure 500 in which the primary and/or secondary grooves are arranged as generally linear segments to provide several triangular and/or diamond shaped zones.

The sole structure 500 of FIG. 15 shows a double curved primary groove 250*c* and an oblique heel primary groove 250*d* similar to those included in the other sole structures described above. Oblique heel primary groove 250*d* is the only primary groove provided rearward of the double curved primary groove 250*c* in this sole structure 500. The oblique heel primary groove 250*d* does not extend as far forward in this example sole structure 500 as it does in the other sole structures described above, and thus forms a somewhat sharper curve or angle.

Forward of the double curved primary groove 250*c*, the sole structure 500 is divided into a plurality of generally triangular or diamond shaped zones that are defined by and/or separated from one another by primary and/or secondary grooves. While other groove arrangements are possible without departing from this invention, in this illustrated example, a first primary groove 550*a* extends continuously as a plurality of generally linear segments from Point A1, forward and lateral to Point A2, and then laterally sidewalls to the lateral sidewall at Point A3. As shown in FIG. 15, primary groove 550*a* opens into the double curved primary groove 250*c* at Point A1. A second primary groove 550*b* extends continuously as a plurality of generally linear segments from the medial sidewall 208 at Point A4, laterally sideways to Point A5, and rearwardly and laterally to Point A2 (where it joins with and opens into primary groove 550*a*). A third primary groove 550*c* extends continuously as a plurality of generally linear segments from the lateral side wall 208 at Point A6, medially sideways to Point A7, and rearwardly and medially to Point A5 (where it joins with and opens into primary groove 550*b*).

A plurality of diagonal secondary grooves 560 extend diagonally (with each secondary groove 560 formed as one or more generally linear segments) across this example sole structure 500 (e.g., in a generally, rear medial-to-front lateral direction or in a generally rear lateral-to-front medial direction), and a plurality of transverse secondary grooves 562 extend in a side-to-side direction across this example sole structure 500 (with each secondary groove 562 formed as one or more generally linear segments). The secondary grooves 560 and 562 may intersect one another and may extend to (and optionally through) the sidewalls 208 of the sole member 500. While other angles and groove arrangements are possible, the diagonal secondary grooves 560 of this example intersect one another at approximately 60° angles, and the diagonal secondary grooves 560 intersect with the transverse secondary grooves 562 at approximately 60° angles. Also, while they may extend to and open into the primary grooves 550*a*-550*c* in their paths, in this illustrated example, the secondary grooves 560 and 562 terminate short of any primary groove 550*a*-550*c* in their path.

Accordingly, in this illustrated example sole structure 500: (a) two primary grooves forward of the double curved primary groove 250*c* extend through the lateral sidewall 208 of the sole structure 500 in the forefoot area (at Points A3 and A6), (b) one primary groove forward of the double curved primary groove 250*c* extends through the medial sidewall 208 of the sole structure 500 (at Point A4), and (c) one primary groove intersects or opens into the double curved primary groove 250*c* (at Point A1). The primary groove that extends through the medial sidewall 208 of the sole structure 500 opens through the sidewall at a location in the front-to-rear direction of the sole structure 500 between the locations where the two primary grooves extend through the lateral sidewall 208 of the sole structure 500.

While grooves 550*a*-550*c* are described above as primary grooves, if desired, one or more (or all) portions or individual segments of these grooves 550*a*-550*c* may be replaced by a secondary groove structure. Also, while grooves 560 and 562 are described above as secondary grooves, if desired, one or more (or all) portions or individual segments of these grooves 560 and/or 562 may be replaced by a primary groove structure.

While FIG. 15 generally illustrates a bottom of a midsole portion of a sole structure 500, one or more tread layers and/or outsole elements of the types described above could be provided, if desired, e.g., between adjacent primary and/or secondary grooves. In some examples, the bottom surface of the sole structure 500 may be formed with shallow recesses therein into which tread layers of the types described above can be fitted (e.g., and attached using cements or adhesives). This example sole structure 500 also could have any of the various structures, features, and/or options described above in conjunction with FIGS. 1-14 and 18.

Upper

Sole structures (e.g., like sole structure 200) in accordance with this invention may be incorporated into footwear having any desired types of uppers 100 without departing from this invention, including conventional uppers as are known and used in the art (including conventional uppers for athletic footwear). As some more specific examples, uppers 100 in accordance with at least some examples of this invention may include uppers having foot securing and engaging structures (e.g., "dynamic" and/or "adaptive fit" structures) of the types described in U.S. Patent Appln. Publication No. 2013/0104423, which publication is entirely incorporated herein by reference. As some additional examples, if desired, uppers and articles of footwear in accordance with this invention may include foot securing and engaging structures of the type used in FLYWIRE® Brand footwear available from NIKE, Inc. of Beaverton, Oreg. Additionally or alternatively, if desired, uppers and articles of footwear in accordance with this invention may include knit materials and/or fused layers of upper materials, e.g., uppers of the types included in NIKE "FLYKNIT™" Brand footwear products and/or NIKE's "FUSE" line of footwear products. As additional examples, uppers of the types described in U.S. Pat. Nos. 7,347,011 and/or 8,429,835 may be used with sole member 200 without departing from this invention (each of U.S. Pat. Nos. 7,347,011 and 8,429,835 is entirely incorporated herein by reference).

Referring to FIGS. 1-3 and 16-17, another example upper 100 that may be used in footwear structures in accordance with this invention is illustrated. This example upper 100 includes multiple layers. The various layers and their locations may be selected for flexibility, durability, shaping, breathability, etc. Different layers and/or combinations of layers may be provided at different areas of the upper 100, e.g., to provide the desired properties, characteristics, and/or aesthetics at the different areas.

A first upper layer 110 may extend over a majority (or even all) of the upper 100. This layer 110 may be the interior-most layer, i.e., it may be positioned closest to the user's foot. According to some aspects, first layer 110 may be a flexible, mesh layer that has good breathability, flexibility, and shaping properties (e.g., a spacer mesh). By way of non-limiting example, first layer 110 may be formed of Vase Mesh (available from You Young Co., Ltd., Korean). Other examples of suitable mesh materials are described, for example, in U.S. Pat. No. 8,429,835.

A second upper layer 120 may extend, for example, over portions of the forefoot region 11 of upper 100. This second layer 120 may include a first suede layer 122 bonded to a second suede layer 124. The first suede layer 122 may be provided with a hot melt adhesive layer 123*a* on one side (see FIG. 17), and the second suede layer 124 also may be provided with a hot melt adhesive layer 123*b* on one side. The second upper layer 120 may be formed by placing the hot melt adhesive layer 123*a* of the first suede layer 122 adjacent to and in contact with the hot melt adhesive layer 123*b* of the second suede layer 124 and bonding the first and second suede layers 122, 124 together using heat and/or pressure (e.g., in the manners described in U.S. Pat. No. 8,429,835). The second upper layer 120 may be provided around the perimeter edges of the forefoot region 11 of the upper 100, e.g., to provide protection and durability. The exposed exterior surface of the second upper layer 120 (e.g., the exposed surface of first suede layer 122) may provide a somewhat tacky surface (such as the suede material), e.g., which may be used to help user's "grip" the skateboard with the upper, e.g., when performing certain tricks or maneuvers.

Figure 16:
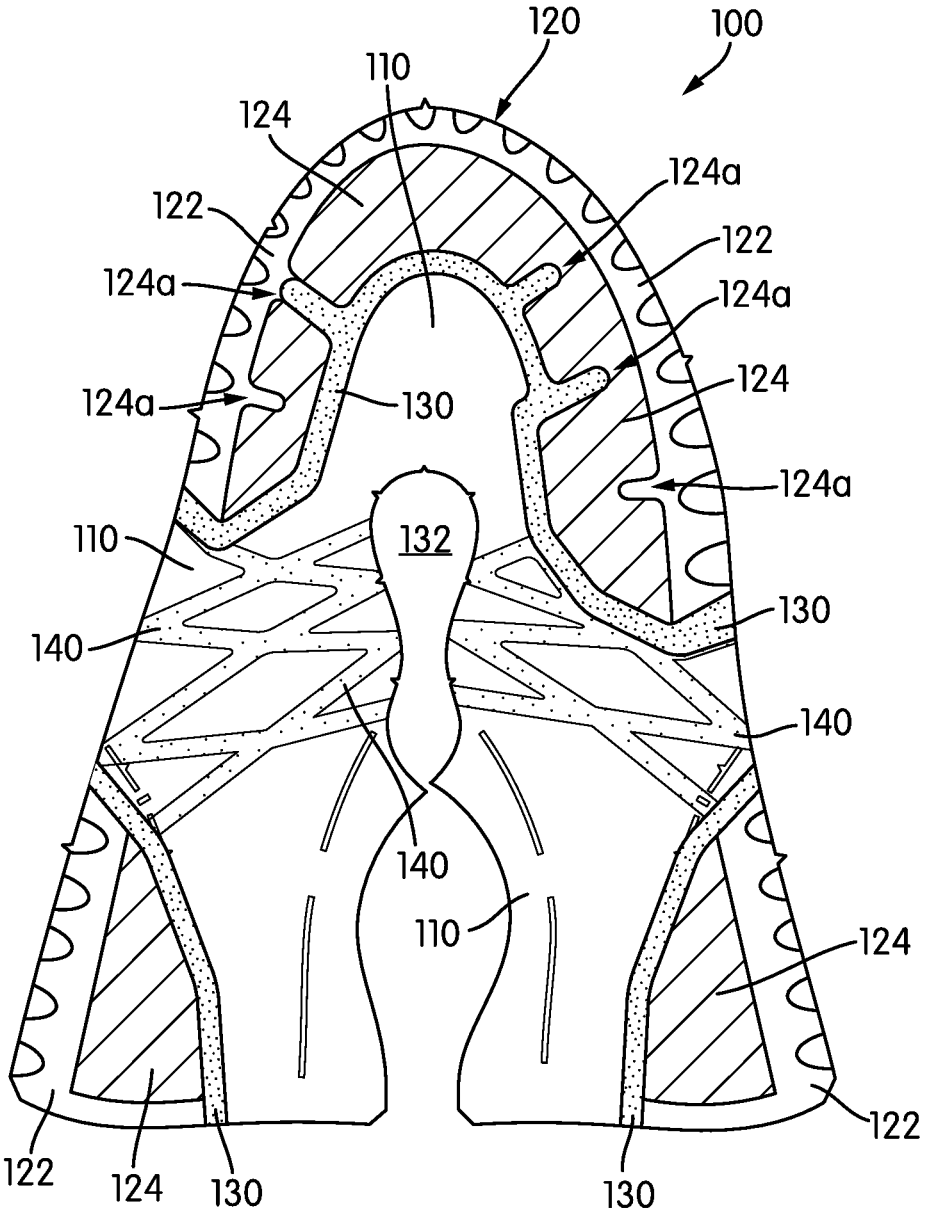
FIG. 16 is a schematic showing an example upper in accordance with aspects of this disclosure.
Figure 17:
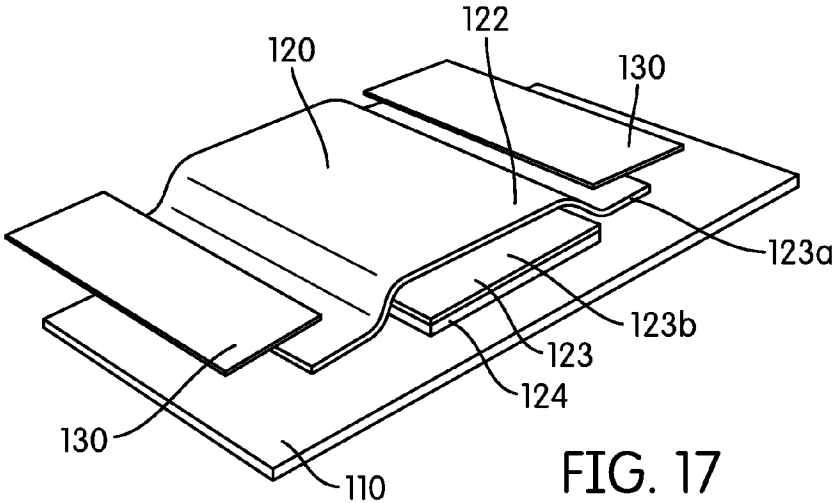
FIG. 17 is a schematic showing various components that may form a portion of an upper in accordance with aspects of this disclosure.

The first suede layer 122 and the second suede layer 124 need not be co-extensive. For example, as shown in FIG. 16, the first suede layer 122 may extend outward toward to edges of the forefoot area a greater distance than the second suede layer 124. This may help provide a smoother joint where the upper layer 120 extends beneath and engages the forefoot sidewall component 230 of sole structure 200 (e.g., just the portion of the upper 100 including the mesh upper layer 110 and the first suede layer 122 may extend behind the sidewall component 230 of the sole member 200 such that the edge of the second suede layer 124 substantially aligns along the top edge of the sidewall component 230). In some structures in accordance with this aspect of the invention, the junction between the sidewall component 230 and the upper 100 will be relatively smooth (e.g., without pronounced or distinct edges, gaps, or changes in surface level) to provide better feel for the skateboard and/or smoother movement of the foot with respect to the skateboard). As a more specific example, in this illustrated structure, the additional thickness of the upper 110 provided by the presence of the second suede layer 124 just beyond the location of the junction with the sidewall component 230 may provide a relatively smooth transition between the sidewall component 230 surface and the upper 100 surface.

By way of non-limiting example, first suede layer 122 may be formed of 0.5 mm Tirrenina suede (available from Kuraray Co., Ltd., of Japan) having one surface coated with a hot melt adhesive. The second suede layer 124 may be formed of a natural suede (e.g., Truly Suede) and/or a synthetic suede, optionally having one surface coated with a hot melt adhesive. Other materials also may be used without departing from this invention, such as substrate materials (e.g., fabrics, textiles, etc.) with TPU films, prints, and/or coatings.

Additionally, as shown in FIG. 16, additional second upper layers 120 may extend over portions of the heel region 13 of the upper 100. As shown in FIGS. 1-3 and 16, the second upper layer 120 may be provided on both the lateral and medial sides of the heel. While the second upper layers 120 at the heel region need not have the same multilayer construction of that described above for the forefoot region, it may have that same multi-layer construction, if desired. The heel region second upper layers 120 may help provide additional abrasion resistance, durability, and/or support in the heel area of the upper 100. Optionally, a conventional heel counter may be included in the upper structure 100, if desired.

The second upper layer 120 may be engaged with the first upper layer 110 in any desired manner without departing from this invention. For example, some areas of the first upper layer 110 may be provided with a hot melt adhesive that will bond to the second upper layer 120, optionally at selected areas of the upper 100 (e.g., around the perimeter edges of the second upper layer 120). As another example, if desired, these upper layers 110 and 120 may be engaged together by sewing, stitching, or other physical connection techniques. As yet another example, some engagement between the upper layers 110 and 120 may occur as a result of engagement of the upper 100 with the sole member 200 and/or with a strobel member (e.g., sidewall component 230 may help hold upper layers 110 and 120 together). In some examples of this invention, the first upper layer 110 will not be connected to the second upper layer 120 throughout the entire area of their adjacent surfaces. In this manner, the mesh layer 110 may "float" or move to some degree with respect to the second upper layer 120.

Additional upper layers or features may be provided, if desired. For example, as shown in FIG. 16, a further layer, a third reinforcing layer 130, also is provided at various locations around the upper structure 100. In this illustrated example, reinforcing layer 130 is provided along the perimeter edges of portions of the second layer 120. Further, reinforcing layer 130 may be used to attach second layer 120 to first layer 110 (e.g., by providing support for stitching or other components for connecting the first upper layer 110 to the second upper layer 120, by providing a substrate for supporting a hot melt material, etc.). By way of non-limiting example, the reinforcing layer 130 may be formed of 0344 HM Millon (available from Daewoo International Corporation of Korea).

Figure 2:
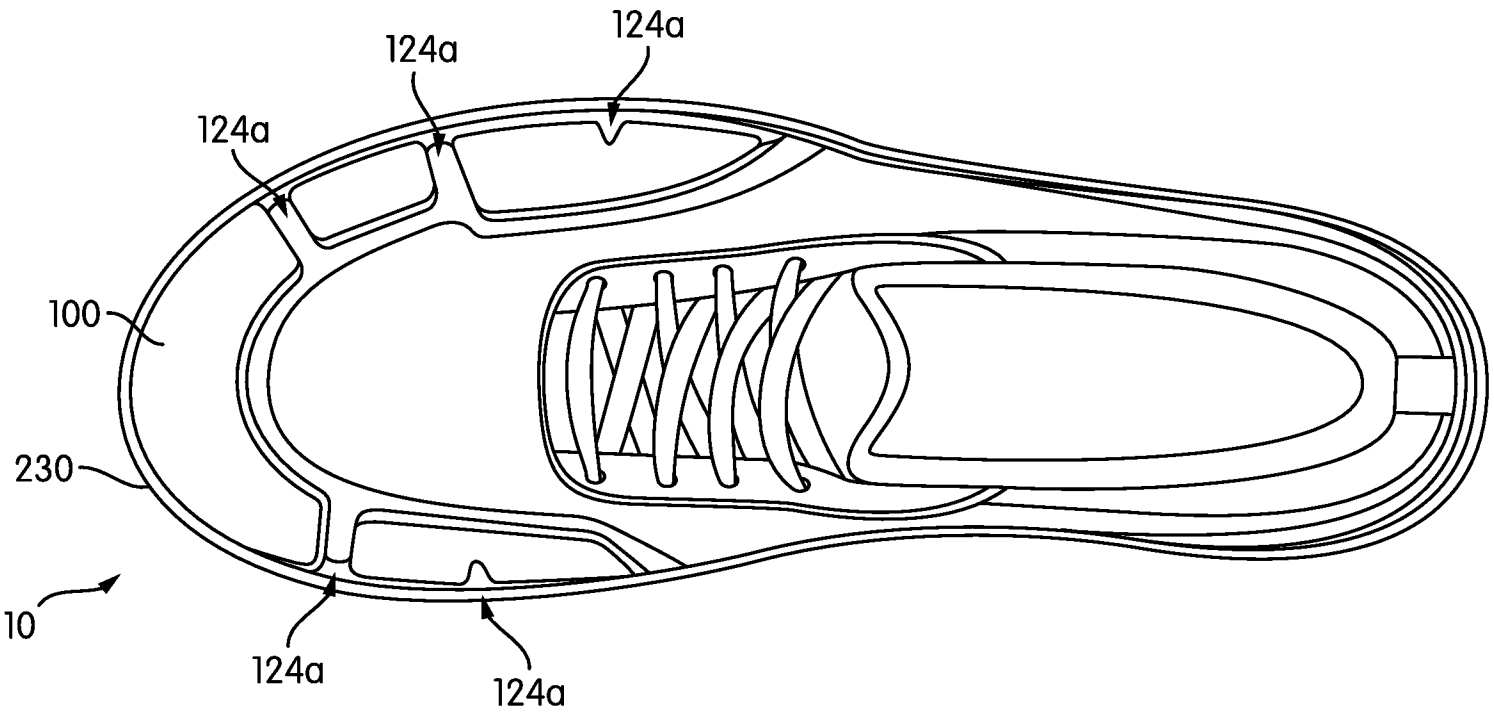
FIG. 2 is a top view of the article of footwear of FIG. 1.

FIG. 16 further shows that the second suede layer 124 of this example structure 100 has some discontinuities and/or flex slots or grooves 124*a* cut into it. Additionally or alternatively, if desired, flex grooves of this type may be provided in the first suede layer 122 and/or the first upper layer 110. Notably, as also shown in FIGS. 1-3, these flex grooves 124*a* also generally align (in a vertical direction) with at least some of the cutouts 234 provided in the sidewall component 230 and/or with at least some of the deep channels 250 that extend to the sides of the sole member 200. These flex grooves 124*a* in the relatively heavy leather/suede material of layer 124 help lighten the upper 100 somewhat and improve its flexibility. The grooves 124*a* may have any desired width dimension (extending across the groove), such as from 0 mm (an abutting joint or a slit in layer 124) to 20 mm. The groove(s) 124*a* may be provided in sizes, shapes, and/or locations to promote upper flexibility and/or mobility, e.g., to match areas of flexibility provided in an associated midsole sidewall 208, sidewall component 230, etc.

FIG. 16 further shows additional material strips 140 extending from the instep or vamp opening 132 of the upper structure 100 to the lateral and medial edges of the upper structure 100. These material strips 140 may be made from any desired materials without departing from this invention and may form any desired pattern around the upper structure 100 without departing from this invention. In some examples of this invention, the material strips 140 will constitute substantially unstretchable members that interact with the footwear lacing system to form portions of the "dynamic fit," "adaptive fit," and/or FLYWIRE® type securing systems described above. Thus, the material strips 140 may be relatively thin, wire-like structures or thicker bands of material, such as natural or synthetic leather strips. The strips 140 may be located inside the mesh layer 110 (optionally between the mesh layer 110 and an internal bootie or other foot-contacting material within the upper 100) and/or between layers of the upper 100.

The upper 100 may include other features as well, such as an interior bootie member that completely or partially fills the foot-receiving void or chamber of the shoe. At the very least, the upper 100 may include a soft material (e.g., textile, foam, etc.) at the ankle area, e.g., around the top edge and into the interior of the foot-receiving opening, to provide a comfortable feel on the wearer's foot.

Also, those skilled in the art, given the benefit of this disclosure, will understand that the upper structures described above (and in conjunction with FIGS. 1-3, 16, and 17) may be used with sole structures other than the sole structures 200 described above in conjunction with FIGS. 4-15. Rather, if desired, the upper structures described above may be used with any desired type of shoe, including any desired type of athletic shoe. The pattern of upper layers can be altered as desired to provide the desired level of durability, abrasion resistance, tackiness, breathability, flexibility, and/or other characteristics at the desired areas of the upper.

Conclusion

As evident from the foregoing, aspects of this invention relate to sole structures for articles of footwear that include: (a) a first sole portion including a first exposed bottom surface area (e.g., for supporting a wearer's toes or phalanges); (b) a second sole portion including a second exposed bottom surface area; and (c) an elongated double curved channel (e.g., an S-shaped channel) located between (and separating) the first and second exposed bottom surface areas. The elongated double curved channel may extend from a medial-side end at a forefoot region of the sole structure to a lateral-side end at or near a midfoot region of the sole structure. A forward portion of this elongated double curved channel has a concave portion facing a medial edge of the sole structure and a rearward portion of this elongated double curved channel has a concave portion facing a lateral edge of the sole structure. See, for example, FIG. 4. The double curved channel may be a deep channel, e.g., having a depth of at least 3 mm over at least 50% of its length (measured as described above in conjunction with FIG. 18).

Another aspect of this invention relates to sole structures for articles of footwear that include: (a) a first sole portion including a first exposed bottom surface area located at least in an arch support region of the sole structure; (b) a second sole portion including a second exposed bottom surface area located at least in a medial heel support region of the sole structure; and (c) an elongated heel channel located between (and separating) the first and second exposed bottom surface areas. The elongated heel channel may extend from a heel edge to the medial edge of the sole structure, and this heel channel may be a deep channel (e.g., having a depth of at least 3 mm over at least 50% of its length (measured as described above)). As shown in FIG. 4, this elongated heel channel may include: (a) a first section that is approximately transversely-centered in the sole structure and longitudinally-extending from the heel edge and (b) a second section that is obliquely-angled and medially extending from the first section.

Sole structures according to additional aspects of this invention may include: (a) a first sole portion including a first exposed bottom surface area located at least in a forefoot support region of the sole structure; (b) a second sole portion including a second exposed bottom surface area located at least in an arch support region of the sole structure; and (c) a transverse flexion channel located between (and separating) the first and second exposed bottom surface areas. This transverse flexion channel (which may be linear, curved, double curved, or S-shaped) includes a medial-side end at a forefoot region of the sole structure and a lateral-side end at or near a midfoot region of the sole structure. In this structure, the first sole portion may include: (a) a longitudinal flexion channel extending from a first end located proximate the lateral-side end of the transverse flexion channel and a second end located proximate a forward toe support region of the sole structure, (b) a first flexion channel extending from a lateral edge of the sole structure to a medial edge of the sole structure, (c) a second flexion channel extending from the lateral edge of the sole structure to the medial edge of the sole structure, and/or (d) a third flexion channel extending from the lateral edge of the sole structure to the transverse flexion channel. At least one (and preferably all) of the transverse flexion channel, the longitudinal flexion channel, the first flexion channel, and the second flexion channel (and optionally the third flexion channel) may be deep channels (e.g., having a depth of at least 3 mm over at least 50% of its respective length (measured as described above in conjunction with FIG. 18)).

Any one or more of the deep channels described above may have, along at least 50% of its length, a depth that is at least 80% of a thickness of the sole structure at the location where the depth is measured (e.g., as described above in conjunction with FIG. 18). Also, if desired, the ends of any one or more of the deep channels described above may extend through sidewalls of the sole structure (e.g., through the lateral sidewall, the medial sidewall, a rear heel sidewall, etc.).

In order to promote more natural motion and flexion and to potentially support enhanced plantarflexion, at least some of the deep grooves described above may have relatively wide width characteristics. As some more specific examples, one or more of the deep grooves described above (such as one or more of the deep grooves extending side-to-side and/or the double curved deep groove) may have a width of approximately 2 to 2.5 mm along at least 50% of its respective length and/or a width of approximately 1 mm to approximately 3.5 mm over at least 75% of its length. Wide widths for deep grooves can help promote more plantar-flexion than is commonly available in conventional sole structures.

Some aspects of this invention may be defined, at least in part, with respect to structures of a human foot that would be supported by sole structures in accordance with this invention. For example, for the double curved channel or transverse flexion channel described above, a medial-side end of the channel may be located proximate to a phalange-to-first metatarsal joint support region of the sole structure and a lateral-side end of the channel may be located proximate to a cuboid-to-metatarsal joint support region of the sole structure. As another potential feature, on a medial side of the sole structure, these channels may extend beneath a region for supporting a joint between the first proximal phalange and the first metatarsal, and on a lateral side of the sole structure, these channels may extend beneath a region for supporting proximal halves of the fourth and fifth metatarsals. These channels also may extend beneath a region for supporting a middle region of a third metatarsal. When it is a double curved channel, the elongated double curved channel may transition from having its concave portion facing the medial edge of the sole structure to having its concave portion facing the lateral edge of the sole structure at an area of the sole structure beneath a region for supporting a third metatarsal.

If desired, in some structures according to this invention, two deep channels may merge or come together to form a single deep channel. As a more specific example, as shown in FIG. 4, the medial side portion of one of the transverse flexion channels in the forefoot sole portion may extend into (and become co-extensive with) a medial side portion of the elongated double curved channel or the transverse channels described above.

Sole structures in accordance with examples of this invention may include substantial flexibility and deep flex groove structures in forefoot and lateral front portions of the sole structure with less flexibility in the midfoot and/or heel areas. The forefoot and lateral front flexibility provides excellent flexibility and dexterity at the front and/or lateral forefoot areas of the shoe (e.g., to aid in providing more natural motion, enhancing plantarflexion and dorsiflexion, and performing skateboarding tricks) with great support in the midfoot and/or heel areas (e.g., energy absorption, to absorb impact forces when landing on the ground). In some sole structures, there will be no deep channels located to a heel-side of the elongated double curved channel or transverse channel in a forefoot portion of the sole structure. At the very least, the area of the sole structure rearward of the double curved channel or the transverse flexion channel may be devoid of deep channels that extend from the lateral edge to the medial edge of the sole structure. Advantageously, the midfoot area of the sole structure may be devoid of deep channels.

In addition to deep grooves, secondary flexion grooves may be provided in various portions of the sole structure, particularly in the forefoot area. The secondary flexion grooves, as described above, may not be as deep or pronounced as deep grooves, but they can help improve flexibility of the overall sole structure while maintaining a somewhat more stable, supportive construction. If desired, secondary flexion grooves may be located between adjacent deep grooves, particularly the deep grooves extending in directions across the forefoot area from the medial side to the lateral side of the sole structure. The secondary flexion grooves may terminate within the sole portion in which it is contained, and optionally may intersect the longitudinal forefoot flexion groove (if any).

The description above mentions that one or more of the deep grooves may extend between (and optionally separate) bottom surface areas of the various sole portions. Nonetheless, two or more (and optionally all) of these sole portions may be formed as a unitary, one-piece construction, e.g., like the platform 210 described above (in which various sole portions or zones are interconnected at their top sides by a unitary plantar support surface).

Still additional aspects of this invention relate to uppers for articles of footwear. Such uppers may include, for example: (a) a mesh layer and (b) one or more textile members joined to the mesh layer. A textile member may include: (1) a first textile layer including a first surface and a second surface opposite the first surface, wherein the second surface includes a first hot melt adhesive layer, and (2) a second textile layer including a first surface and second surface opposite the first surface, wherein the second surface of the second textile layer includes a second hot melt adhesive layer. The first hot melt adhesive layer may be arranged to face and contact the second hot melt adhesive layer to thereby join the first textile layer with the second textile layer (e.g., when heat and/or pressure is applied). The first and second textile layers need not be co-extensive. If desired, the textile member(s) may be joined to the mesh layer at less than an entire interfacing surface area of the mesh layer and the textile member(s) so that some overlapping portions of the mesh layer can move (e.g., "float") relative to the textile member layer.

The mesh layer may be provided at all or substantially all areas of the shoe upper (e.g., to provide a flexible base and excellent breathability). One or more textile members may be provided at areas where different upper properties or characteristics are desired (e.g., improved durability, improved abrasion resistance, improved "tackiness" or grip, etc.). As some more specific examples, one or more textile members may be provided to extend around a toe area of the upper and/or around the forefoot medial and/or lateral sides of the upper. Additionally or alternatively, one or more other textile members may be provided at a lateral heel area and/or a medial heel area of the upper.

As noted above, the various layers of a textile member need not be co-extensive with one another. As best seen from FIG. 16, in that example structure, at least one edge of the first textile layer (e.g., the outermost textile layer) may extend beyond at least one edge of the second textile layer (an inner textile layer). In this manner, the second textile layer may be at least partially located between the mesh layer and the first textile layer. Selective positioning of the second textile layer can enable a designer or manufacturer to control the flexibility and/or breathability of the upper construction and/or reduce the overall weight of the upper. Slots and/or gaps, such as slots or grooves 124*a* noted above, may be provided in one or more of the first and/or second material layers of the textile member, e.g., also to assist in flexibility, breathability, and/or upper weight control. Additionally, if desired, slots and/or gaps in one or more of the material layers of the textile member(s) may correspond in location to where the deep flex grooves in the sole structure (if any) extend through the sidewalls of the sole member, so that the upper and sole member constructions cooperate to provide enhanced flexibility and natural motion feel.

While the invention has been described with respect to specific examples including presently preferred modes of carrying out the invention, those skilled in the art, given the benefit of this disclosure, will appreciate that there are numerous variations and permutations of the above described structures, systems and techniques that fall within the spirit and scope of the invention as set forth above. Given the benefit of this disclosure, it becomes apparent that variations and/or combinations of these features may be combined. Further, a wide variety of materials, having various properties, i.e., flexibility, hardness, durability, etc., may be used without departing from the invention. Finally, all examples, whether preceded by "for example," "such as," "including," or other itemizing terms, or followed by "etc.," are meant to be non-limiting examples, unless otherwise stated or obvious from the context of the specification.

We claim:

1. An upper for an article of footwear, comprising:

a mesh layer; and a first textile member joined to the mesh layer, wherein the first textile member includes:

a first textile layer including a first surface and a second surface opposite the first surface, wherein the second surface includes a first hot melt adhesive layer, and a second textile layer including a first surface and second surface opposite the first surface, wherein the second surface of the second textile layer includes a second hot melt adhesive layer, wherein the first hot melt adhesive layer contacts the second hot melt adhesive layer to thereby join the first textile layer with the second textile layer, and wherein the first surface of the second textile layer and the mesh layer are free of adhesive therebetween such that they are in direct contact with one another.

2. An upper according to claim 1, wherein the first textile member is joined to the mesh layer at less than an entire interfacing surface area of the mesh layer and the first textile member so that some overlapping portions of the mesh layer are movable relative to the first textile member.

3. An upper according to claim 1, wherein the first textile member is provided at a toe area of the upper.

4. An upper according to claim 1, wherein the first textile member is provided at a lateral heel area of the upper.

5. An upper according to claim 1, wherein the first textile member is provided at a medial heel area of the upper.

6. An upper according to claim 1, wherein the first textile layer is made from natural or synthetic leather, and wherein the second textile layer is made from natural or synthetic leather.

7. An upper according to claim 1, wherein at least one edge of the first textile layer extends beyond at least one edge of the second textile layer.

8. An upper according to claim 1, wherein the second textile layer is at least partially located between the mesh layer and the first textile layer.

9. An upper according to claim 1, wherein at least one of the first textile layer and the second textile layer is made from a suede material.

10. An upper according to claim 1, wherein the first textile member is provided at a toe area of the upper, and wherein the upper further comprises:

a second textile member joined to the mesh layer, wherein the second textile member is separated from the first textile member and is located at a heel area of the upper, and wherein the second textile member includes:

a third textile layer including a first surface and a second surface opposite the first surface, wherein the second surface of the third textile layer includes a first hot melt adhesive layer, and a fourth textile layer including a first surface and second surface opposite the first surface, wherein the second surface of the fourth textile layer includes a second hot melt adhesive layer, wherein the first hot melt adhesive layer of the second textile member contacts the second hot melt adhesive layer of the second textile member to thereby join the third textile layer with the fourth textile layer.

11. An upper according to claim 10, wherein the second textile member is located at a medial heel area of the upper.

12. An upper according to claim 11, further comprising:

a third textile member joined to the mesh layer, wherein the third textile member is separated from the first textile member and is located at a lateral heel area of the upper, and wherein the third textile member includes:

a fifth textile layer including a first surface and a second surface opposite the first surface, wherein the second surface of the fifth textile layer includes a first hot melt adhesive layer, and a sixth textile layer including a first surface and second surface opposite the first surface, wherein the second surface of the sixth textile layer includes a second hot melt adhesive layer, wherein the first hot melt adhesive layer of the third textile member contacts the second hot melt adhesive layer of the third textile member to thereby join the fifth textile layer with the sixth textile layer.

13. An upper according to claim 12, wherein the third textile member is joined with the second textile member at a rear heel area of the upper.

14. An upper according to claim 1, wherein a lower lateral side edge of the second textile layer has a first slot defined in it, wherein the first slot is located at a forefoot area of the upper where a wearer's foot will bend the upper.

15. An upper according to claim 14, wherein a lower medial side edge of the second textile layer has a second slot defined in it, wherein the second slot is located at a forefoot area of the upper where a wearer's foot will bend the upper.

16. An upper according to claim 1, wherein a lower medial side edge of the second textile layer has a first slot defined in it, wherein the first slot is located at a forefoot area of the upper where a wearer's foot will bend the upper.

17. An upper according to claim 1, wherein an upper lateral side edge of the second textile layer has a first slot defined in it.

18. An upper according to claim 17, wherein the upper lateral side edge of the second textile layer has a second slot defined in it, wherein the second slot is located closer to a heel area of the upper than the first slot.

19. An upper according to claim 1, wherein the first textile member further includes a third textile layer including a first surface and second surface opposite the first surface, wherein the second surface of the third textile layer includes a third hot melt adhesive layer, wherein the first hot melt adhesive layer contacts the third hot melt adhesive layer to thereby join the first textile layer with the third textile layer.

20. An upper according to claim 19, wherein the second textile layer and the third textile layer are spaced apart from one another and are engaged with a single, continuous piece of the first textile layer.

21. An upper according to claim 20, wherein each of the second textile layer and the third textile layer is located in a forefoot region of the upper.

22. An upper according to claim 19, wherein the second textile layer and the third textile layer are spaced apart from one another.

23. An article of footwear, comprising:

an upper including (a) a mesh layer and (b) a first textile member joined to the mesh layer, wherein the first textile member includes:

a first textile layer including a first surface and a second surface opposite the first surface, wherein the second surface includes a first hot melt adhesive layer, and a second textile layer including a first surface and second surface opposite the first surface, wherein the second surface of the second textile layer includes a second hot melt adhesive layer, wherein the first hot melt adhesive layer contacts the second hot melt adhesive layer to thereby join the first textile layer with the second textile layer wherein the first surface of the second textile layer and the mesh layer are free of adhesive therebetween such that they are in direct contact with one another; and a sole structure engaged with the upper.

24. An article of footwear according to claim 23, wherein the sole structure includes:

a first sole portion having a first exposed bottom surface area;

a second sole portion having a second exposed bottom surface area; and an elongated double curved channel located between the first exposed bottom surface area and the second exposed bottom surface area, wherein the elongated double curved channel extends from a medial-side end at a forefoot region of the sole structure to a lateral-side end at or near a midfoot region of the sole structure, wherein a forward portion of the elongated double curved channel has a concave portion facing a medial edge of the sole structure and a rearward portion of the elongated double curved channel has a concave portion facing a lateral edge of the sole structure, and wherein the elongated double curved channel has a depth of at least 3 mm over at least 50% of its length.

25. An article of footwear according to claim 24, wherein, along at least 50% of its length, the depth of the elongated double curved channel is at least 80% of a thickness of the sole structure.

26. An article of footwear according to claim 24, wherein the elongated double curved channel has a width at its open end of approximately 1.0 mm to approximately 3.5 mm over at least 75% of its length.

27. An article of footwear according to claim 24, wherein a lower medial side edge of the second textile layer has a first slot defined in it, wherein the medial-side end of the elongated double curved channel extends through a medial sidewall of the sole structure, and wherein the first slot is substantially aligned with the medial-side end of the elongated double curved channel at a location where the medial-side end of the elongated double curved channel extends through the medial sidewall.

28. An article of footwear according to claim 24, wherein a medial side of the second textile layer has a first slot or groove defined in it, wherein the medial-side end of the elongated double curved channel extends through a medial sidewall of the sole structure, and wherein the first slot or groove is substantially aligned with the medial-side end of the elongated double curved channel at a location where the medial-side end of the elongated double curved channel extends through the medial sidewall.

29. An article of footwear according to claim 23, wherein the sole structure includes:

a first sole portion having a first exposed bottom surface area located at least in an arch support region of the sole structure;

a second sole portion having a second exposed bottom surface area located at least in a medial heel support region of the sole structure; and an elongated heel channel located between and separating the first exposed bottom surface area from the second exposed bottom surface area, wherein the elongated heel channel extends from a heel edge to a medial edge of the sole structure, and wherein the elongated heel channel has a depth of at least 3 mm over at least 50% of its length.

30. An article of footwear according to claim 23, wherein the sole structure includes:

a first sole portion having a first exposed bottom surface area located at least in a forefoot support region of the sole structure;

a second sole portion having a second exposed bottom surface area located at least in an arch support region of the sole structure; and a transverse flexion channel located between and separating the first exposed bottom surface area of the first sole portion from the second exposed bottom surface area of the second sole portion, wherein the transverse flexion channel includes a medial-side end at a forefoot region of the sole structure and a lateral-side end at or near a midfoot region of the sole structure, wherein the first sole portion includes: (a) a longitudinal flexion channel extending from a first end located proximate the lateral-side end of the transverse flexion channel and a second end located proximate a forward toe support region of the sole structure, (b) a first flexion channel extending from a lateral edge of the sole structure to a medial edge of the sole structure, (c) a second flexion channel extending from the lateral edge of the sole structure to the medial edge of the sole structure, and (d) a third flexion channel extending from the lateral edge of the sole structure to the transverse flexion channel, and wherein each of the transverse flexion channel, the longitudinal flexion channel, the first flexion channel, and the second flexion channel has a depth of at least 3 mm over at least 50% of its respective length.

31. An article of footwear according to claim 23, wherein the sole structure includes:

a first sole portion having a first exposed bottom surface area located in a forefoot area of the sole structure;

a second sole portion having a second exposed bottom surface area located in the forefoot area or a midfoot area of the sole structure; and a transverse channel located between the first exposed bottom surface area and the second exposed bottom surface area, wherein the transverse channel extends from a medial-side end of the sole structure to a lateral-side end of the sole structure, and wherein the transverse channel has a depth of at least 3 mm over at least 50% of its length.

32. An article of footwear according to claim 31, wherein a medial side edge of the second textile layer has a first slot or groove defined in it, wherein the medial-side end of the transverse channel extends through a medial sidewall of the sole structure, and wherein the first slot or groove is substantially aligned with the medial-side end of the transverse channel at a location where the medial-side end of the transverse channel extends through the medial sidewall.

33. An article of footwear according to claim 32, wherein a lateral side edge of the second textile layer has a second slot or groove defined in it, wherein the lateral-side end of the transverse channel extends through a lateral sidewall of the sole structure, and wherein the second slot or groove is substantially aligned with the lateral-side end of the transverse channel at a location where the lateral-side end of the transverse channel extends through the lateral sidewall.

34. An article of footwear according to claim 31, wherein a lateral side edge of the second textile layer has a first slot or groove defined in it, wherein the lateral-side end of the transverse channel extends through a lateral sidewall of the sole structure, and wherein the first slot or groove is substantially aligned with the lateral-side end of the transverse channel at a location where the lateral-side end of the transverse channel extends through the lateral sidewall.

* * * * *